US009731528B2

(12) United States Patent
Akahane et al.

(10) Patent No.: US 9,731,528 B2
(45) Date of Patent: Aug. 15, 2017

(54) RECORDING APPARATUS

(71) Applicant: SEIKO EPSON CORPORATION, Tokyo (JP)

(72) Inventors: Hisayuki Akahane, Matsumoto (JP); Naoki Horie, Matsumoto (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/005,587

(22) Filed: Jan. 25, 2016

(65) Prior Publication Data

US 2016/0257146 A1 Sep. 8, 2016

(30) Foreign Application Priority Data

Mar. 6, 2015 (JP) ..... 2015-044629
Mar. 6, 2015 (JP) ..... 2015-044640

(51) Int. Cl.
*B41J 3/46* (2006.01)
*B41J 3/36* (2006.01)
*B41J 29/02* (2006.01)

(52) U.S. Cl.
CPC ..... *B41J 29/02* (2013.01); *B41J 3/36* (2013.01); *B41J 3/46* (2013.01); *B41J 29/023* (2013.01)

(58) Field of Classification Search
CPC ..... B41J 3/46; B41J 3/36
See application file for complete search history.

(56) References Cited

U.S. PATENT DOCUMENTS 4,482,063 A * 11/1984 Berke ..... H05F 3/02 211/69.1
2006/0029424 A1* 2/2006 Kawai ..... B41J 29/02 399/125
2006/0083564 A1* 4/2006 Yazawa ..... B41J 29/023 399/363
2006/0283695 A1* 12/2006 Deshimaru ..... B41J 29/13 200/293
2008/0044197 A1* 2/2008 Muraki ..... G03G 15/5016 399/81
2008/0182639 A1* 7/2008 Antonopoulos ..... G07F 9/02 463/17
2009/0219588 A1* 9/2009 Nakai ..... G09F 19/22 358/527

(Continued)

FOREIGN PATENT DOCUMENTS

CA EP 2228972 A1 * 9/2010 ..... G06F 1/162
JP 2011-042125 3/2011
JP 2011-042476 3/2011

*Primary Examiner* — Shelby Fidler
(74) *Attorney, Agent, or Firm* — Workman Nydegger

(57) ABSTRACT

A recording apparatus includes an apparatus main body portion that contains a recorder that performs recording on a recording medium, and a panel having a display unit that displays various information and being capable of opening and closing an upper portion of the apparatus main body portion by pivoting about a first pivot shaft. The panel has an outer perimeter that includes two short sides and two long sides. The display unit has an outline that includes two short sides and two long sides and is provided on the panel so that a longitudinal direction of the display unit coincides with a longitudinal direction of the panel. The longitudinal direction of the panel intersects a direction of the first pivot shaft about which the panel pivots.

21 Claims, 18 Drawing Sheets

(56) References Cited

U.S. PATENT DOCUMENTS

| | | | | |
|---|---|---|---|---|
| 2010/0066796 | A1* | 3/2010 | Yanagi | B41J 29/13 347/108 |
| 2011/0051184 | A1* | 3/2011 | Fukuda | G06Q 20/20 358/1.15 |
| 2012/0224201 | A1* | 9/2012 | Asahina | B41J 3/44 358/1.12 |
| 2013/0027497 | A1* | 1/2013 | Terrill | B41J 29/13 347/222 |
| 2015/0248654 | A1* | 9/2015 | Chen | G07G 1/0018 358/1.15 |
| 2016/0063468 | A1* | 3/2016 | Sasaki | G06Q 20/20 705/25 |

* cited by examiner

RECORDING APPARATUS

BACKGROUND

1. Technical Field

The present invention relates to a recording apparatus that performs recording on a recording medium and that includes a pivotable panel that has a display unit that displays various information and the like.

2. Related Art

Some of the recording apparatus represented by printers can be used standalone, without being connected to a computer. In some such printers, a display unit that displays various information, images, etc. is provided so as to be capable of being tilted via a tilt mechanism (see, for example, JP-A-2011-42125) Furthermore, some standalone type printers are portable printers specialized in printing on postcards, small-size photograph paper sheets, etc. The printer described in JP-A-2011-42125 is an example of such portable printers. Furthermore, many of such portable type printers are provided with a handle for transportation as shown in JP-A-2011-42476.

However, as for the related-art portable printers, it cannot be said that their characteristics, for example, a relation between the shape of the display unit and the tilting directions thereof in light of the use of the printers for creating postcards, do not appropriately meet users' needs. Furthermore, the display unit is preferred to be larger in order to secure good visibility; however, a size increase of the display unit usually results in an increased weight such that, when the printer is transported, the display unit may unintentionally open and bring about an unfavorable result, such as breakage or the like.

SUMMARY

An advantage of some aspects of the invention is that, in a portable type printer, users' needs that the related-art printers do not appropriately meet are more appropriately met by providing a structure for disposing a panel mentioned above. That is, a recording apparatus capable of realizing both better visibility of the display unit and more appropriate portability is advantageously provided.

The invention can be realized in various forms as described below each of which achieves at least a part of the foregoing advantage.

According to an aspect of the invention, a recording apparatus includes an apparatus main body portion that contains a recorder that performs recording on a recording medium, and a panel having a display unit that displays various information and being capable of opening and closing an upper portion of the apparatus main body portion by pivoting relative to the apparatus main body portion about a first pivot shaft. The panel has an outer perimeter that includes two short sides and two long sides. The display unit has an outline that includes two short sides and two long sides and is provided on the panel so that a longitudinal direction of the display unit coincides with a longitudinal direction of the panel. A direction of the first pivot shaft about which the panel pivots intersects the longitudinal direction of the panel.

According to the foregoing recording apparatus, since the panel having the display unit and being pivotable about the first pivot shaft is provided so that the longitudinal direction (the longitudinal direction of the panel and the display unit) intersects the direction of the first pivot shaft, the panel is opened into a state in which the longitudinal direction of the panel is along a vertical up-down direction in a view from a user. Therefore, for example, in conjunction with the use for creating postcards that may often be used in the portrait or vertical orientation, the display area of the display unit can be fully utilized to display an edited image, so that the editing operation is more facilitated and users' needs can be more appropriately met.

In the foregoing recording apparatus, the display unit may have a size that is larger than or equal to a postcard size.

According to this construction, since the size of the display unit is larger than or equal to the postcard size, an edited image displayed in the display unit can be made closer to an actual completed image, so that the editing operation is more facilitated and users' needs are even more appropriately met.

The foregoing recording apparatus may further have a construction in which in the apparatus main body portion, the first pivot shaft is provided at a side surface portion in a direction that intersects a recording medium transport direction, and in which when the apparatus main body portion is placed so that the panel in an open state is at a near side, the recording medium transport direction is a left-right direction.

Usually, a recording apparatus is provided with a discharge tray that receives recording media discharged from the apparatus after being subjected to recording. According to the foregoing construction in the invention, when the apparatus main body portion is placed with the opened panel being at the near side to a user, the recording medium transport direction is the left-right direction to the user, so that when the user operates the panel, the discharge tray does not interfere with the user's operation. Thus, the operability of the panel improves.

The foregoing construction of the recording apparatus may further include a construction in which when the apparatus main body portion is placed so that a discharge opening of the recording medium is at a near side, the first pivot shaft is at a right side surface of the apparatus main body portion.

This construction, in which when the apparatus main body portion is placed with discharge opening of the recording medium being at the near side to a user, the first pivot shaft is at the right side surface of the apparatus main body portion, achieves the aforementioned operation and effects.

In the foregoing recording apparatus, the panel, when closed, may cover an entire region of the upper portion of the apparatus main body portion in a direction that intersects the recording medium transport direction.

According to this construction, since the closed panel covers the entire region of the upper portion of the apparatus main body portion in the direction intersecting the recording medium transport direction, the integrated appearance of the apparatus main body portion and the panel improves and the beauty of the apparatus improves.

The foregoing recording apparatus may further include a medium setting unit in which the recording medium is set, a carriage that is provided with the recorder and that is movable in a direction that intersects the recording medium transport direction, and an arm that maintains an open state of the panel by engaging with the panel, and a position of the arm in the recording medium transport direction may be between the medium setting unit and the carriage.

This construction, in which the arm that maintains the open state of the panel by engaging with the panel is provided and the position of the arm in the recording medium transport direction is a position between the medium setting unit and the carriage, can restrain size increase of the apparatus by effectively utilizing the region present between the medium setting unit and the carriage.

The arm may hold the panel at a plurality of angles of aperture.

According to this construction, since the arm holds the panel at the plurality of angles of aperture, the operability of the apparatus by users further improves.

In the recording apparatus, in an apparatus height direction, at least a portion of the arm and at least a portion of the carriage may be at positions equal in height.

According to this construction, since in the apparatus height direction, at least a portion the arm and at least a portion of the carriage are located at the same height, the measurement of the apparatus in the height direction is not equal to but less than the sum of the measurement of the arm and the measurement of the carriage in the height direction. Thus, the height-direction measurement of the recording apparatus can be restrained and the size of the apparatus can be reduced.

The foregoing recording apparatus may further include a handle pivotable relative to the apparatus main body portion about a second pivot shaft, and both the first pivot shaft and the second pivot shaft may be provided at the same side surface side of the apparatus main body portion.

According to this construction, since both the first pivot shaft, which is the pivot shaft of the panel, and the second pivot shaft, which is the pivot shaft of the handle, are provided at the same side surface side of the apparatus main body portion, it is possible to avoid an incident in which the panel is unintentionally opened when the recording apparatus is carried by grasping the handle. This makes it possible to secure a more appropriate portability of the recording apparatus while realizing an increased size of the panel.

In the foregoing recording apparatus, the upper surface of the apparatus main body portion may change between when the recording apparatus is in a state for recording and when the recording apparatus is in a state for carrying the recording apparatus by grasping the handle, and the first pivot shaft and the second pivot shaft may be provided at a surface side of the apparatus main body portion which is a side surface side when the recording apparatus is in the state for recording.

Furthermore, a pivot axis of the first pivot shaft and a pivot axis of the second pivot shaft may be substantially parallel to each other.

Still further, the second pivot shaft may be below the first pivot shaft.

Further, in the foregoing recording apparatus, the panel may be provided pivotably relative to the apparatus main body portion via a hinge portion that includes the first pivot shaft, and the handle may be provided pivotably relative to the apparatus main body portion via an attaching member that includes the second pivot shaft, and the apparatus main body portion may include an upper-side apparatus main body portion that constitutes an upper side and a lower-side apparatus main body portion that constitutes a lower side, and the hinge portion, the upper-side apparatus main body portion, and the lower-side apparatus main body portion may be fixed to the attaching member.

According to this construction, since the hinge portion, the upper-side apparatus main body portion, and the lower-side apparatus main body portion are fixed to the attaching member, the weight of both the panel and a recording apparatus main body constituted by the apparatus main body portion will act on the attaching member when the handle is grasped. That is, because the handle appropriately bears the weight of the recording apparatus, it is possible to restrain the recording apparatus from being damaged or the like when the apparatus is carried by grasping the handle.

In the foregoing construction, a side surface of the lower-side apparatus main body portion may be provided with a protruded portion that is protruded sideways, and the protruded portion may be provided with the attaching member.

According to this construction, since the side surface of the lower-side apparatus main body portion is provided with the sideways-protruding protruded portion and the protruded portion is provided with the attaching member, the rigidity of the side surface of the lower-side apparatus main body portion can be increased due to formation of the protruded portion on the side surface of the lower-side apparatus main body portion. Because the attaching member, that is, the handle, is attached to the site (protruded portion) that has an increased rigidity as described above, it is possible to restrain the apparatus main body portion from being damaged when the recording apparatus is carried by grasping the handle.

This recording apparatus may further have a construction in which the handle has a substantially square U shape and in which when the handle is closed, the handle lies around the protruded portion and constitutes, together with the protruded portion, a side surface of the recording apparatus without protruding outward from the side surface of the lower-side apparatus main body portion.

Due to this construction, recesses and protrusions of the side surface of the apparatus are reduced (or substantially eliminated), so that the beauty of the side surface of the apparatus improves.

In this recording apparatus, the handle may be provided with a recess portion that receives the second pivot shaft, and the recess portion may be provided with an allowance that, when the handle is closed, allows the handle to move in a direction that intersects a pivot axis direction of the handle, and the handle, when closed, may assume a state in which a gap between the handle and the protruded portion is eliminated due to urging force of an urger.

According to this construction, since, due to the urging force of the urger, the handle in the closed state assumes the state in which the gap between the handle and the protruded portion is eliminated, the beauty of the side surface of the apparatus can be further improved.

In the foregoing construction of the recording apparatus, the handle and the panel may have a positional relation such that neither one of the handle and the panel interferes with the other one of the handle and the panel when pivoting.

Due to this positional relation, the operability of the handle and the panel improves.

BRIEF DESCRIPTION OF THE DRAWINGS

The invention will be described with reference to the accompanying drawings, wherein like numbers reference like elements.

DESCRIPTION OF EXEMPLARY EMBODIMENTS

Recording apparatuses according to exemplary embodiments of the invention will be described hereinafter with reference to the drawings. Note that the invention is not restricted by the following exemplary embodiments.

First, a recording apparatus according to an exemplary embodiment of the invention will be described. As an example of the recording apparatus of the invention, an ink jet type printer will be described.

Figure 1A:
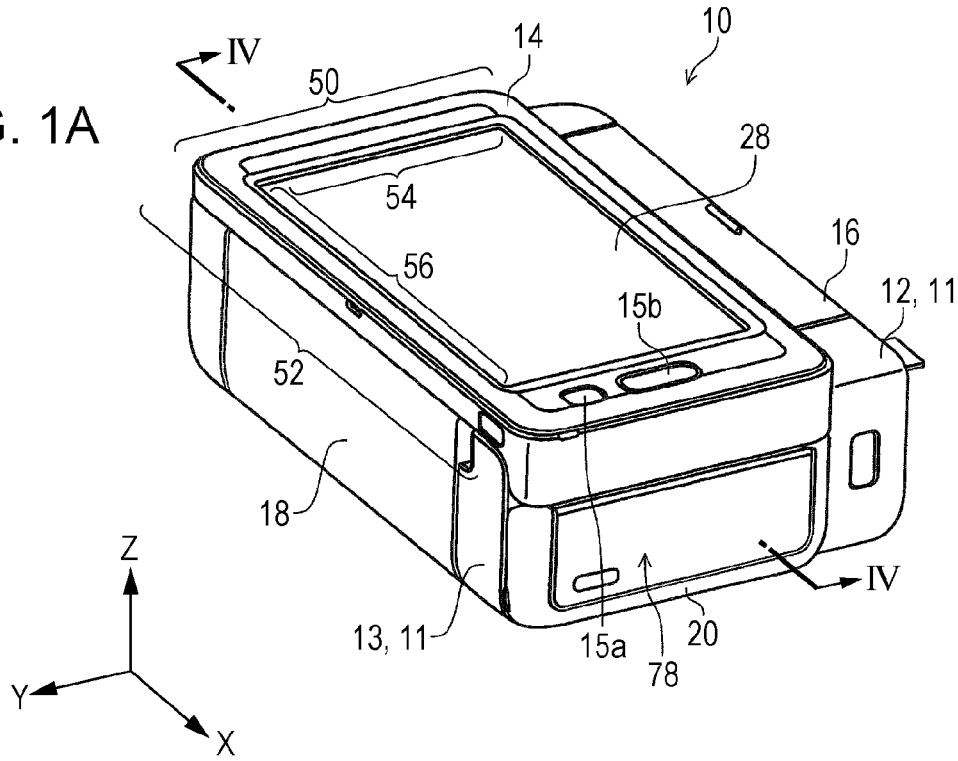
FIG. 1A is a perspective view representing an apparatus main body of a printer.
Figure 1B:
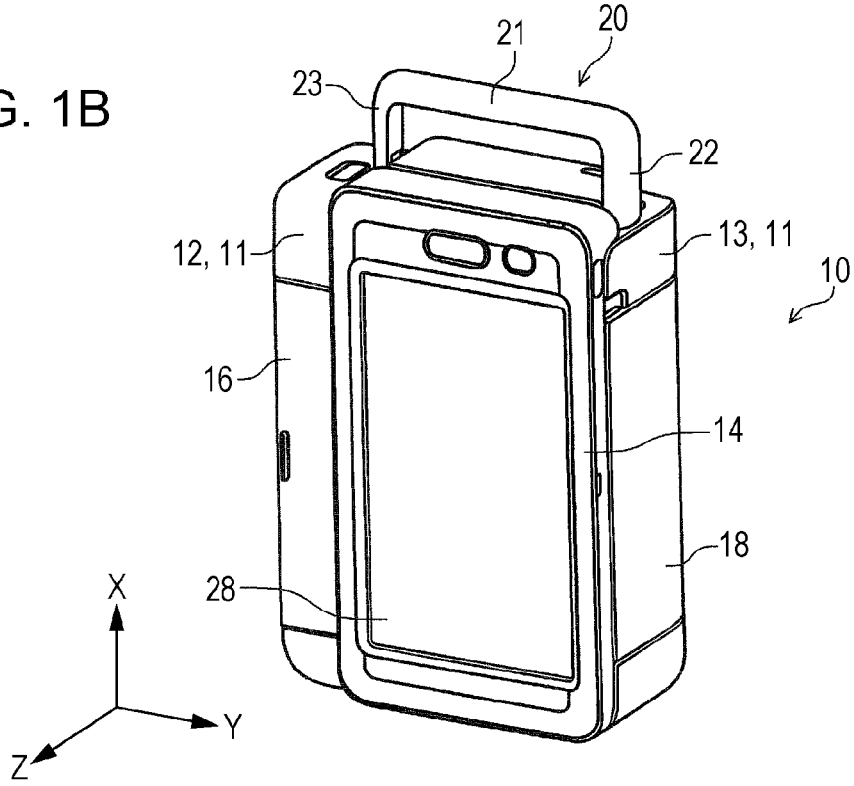
FIG. 1B is a perspective view representing a state in which a handle of the printer is open.
Figure 2A:
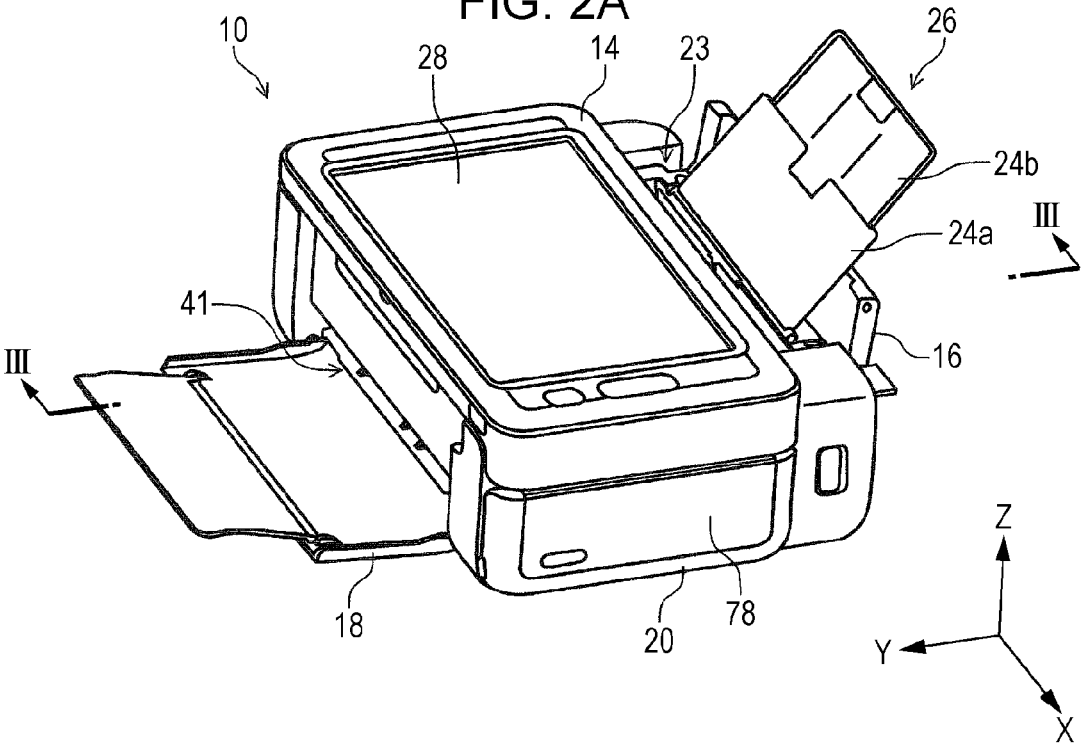
FIG. 2A is a perspective view representing a state in which a sheet feed cover and a sheet discharge cover of the printer are open.
Figure 2B:
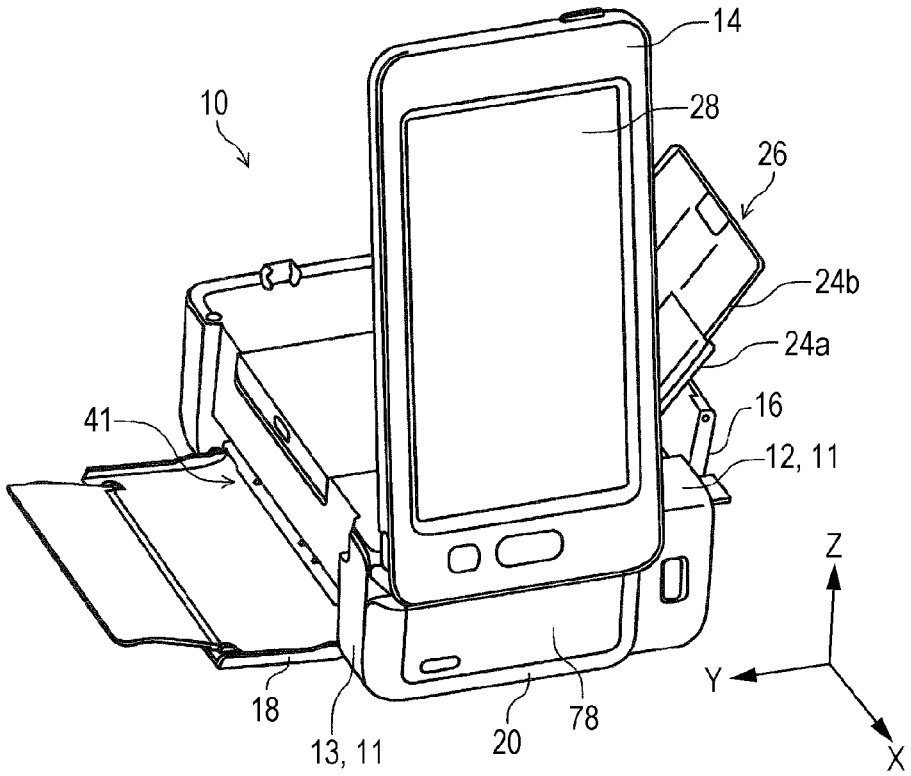
FIG. 2B is a perspective view representing a state in which a panel is open.
Figure 3:
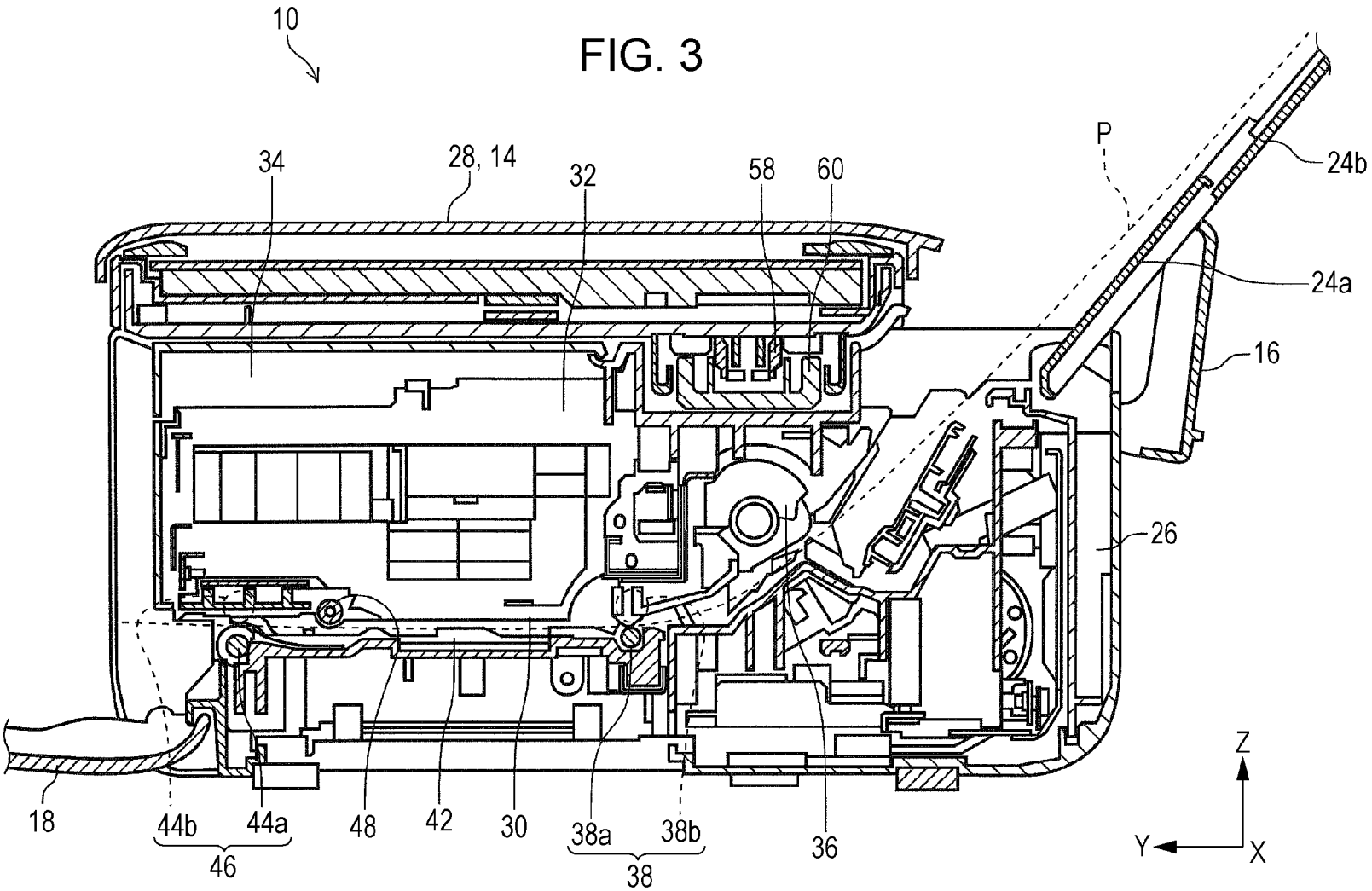
FIG. 3 is a sectional view of a printer.
Figure 4:
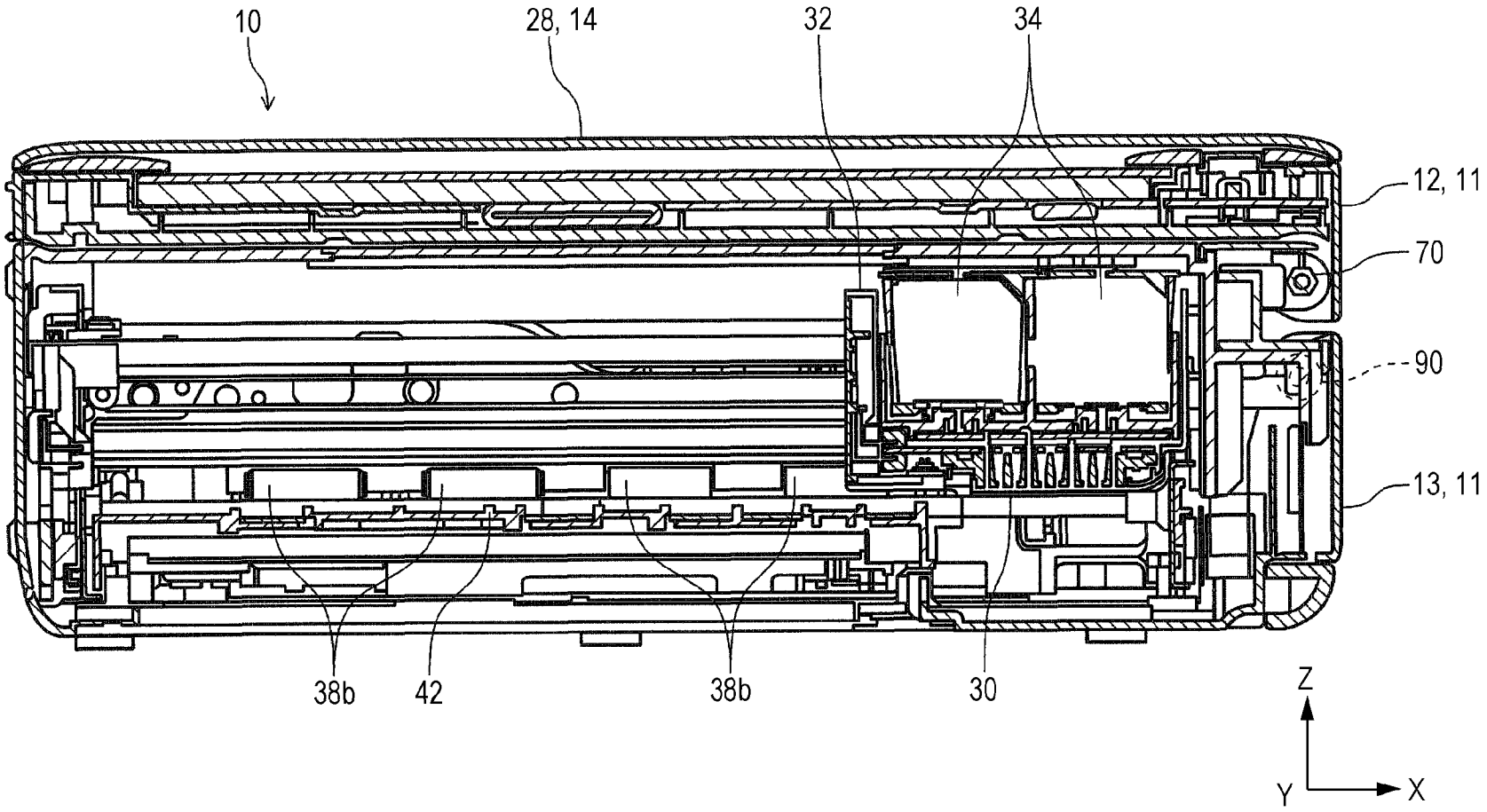
FIG. 4 is a sectional view of the printer.
Figure 5A:
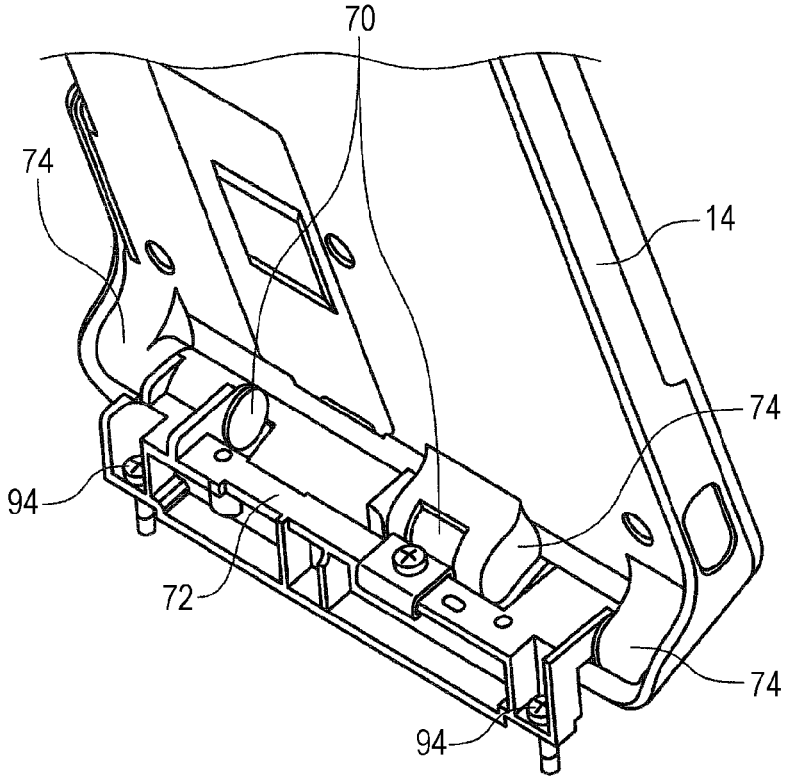
FIG. 5A is a perspective view of a panel and a hinge portion.
Figure 5B:
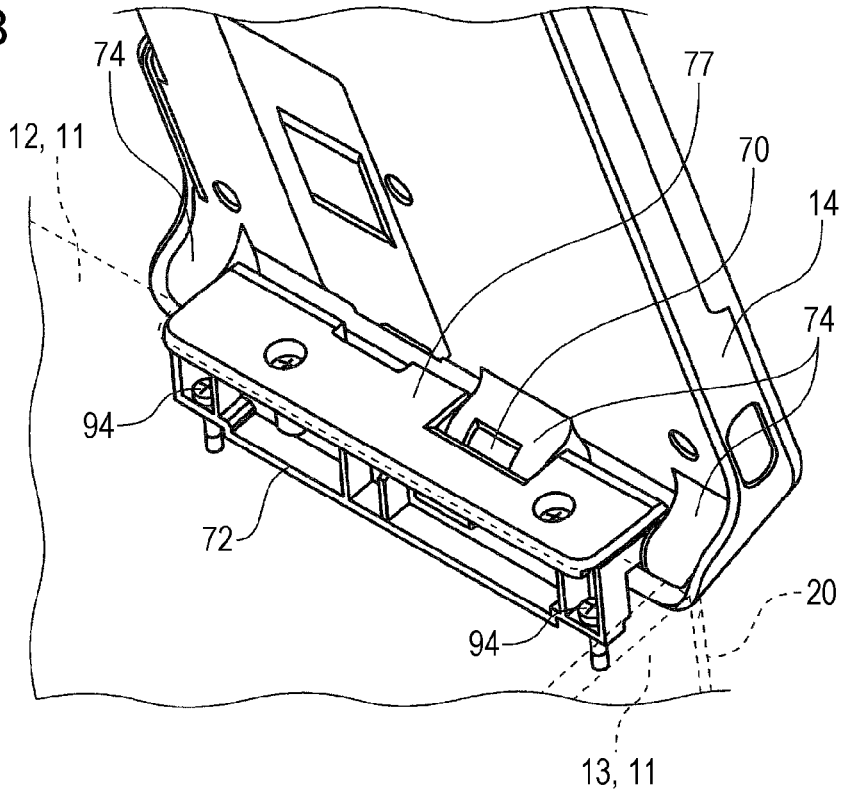
FIG. 5B is a diagram illustrating a state in which the panel is attached to an apparatus main body portion.
Figure 6:
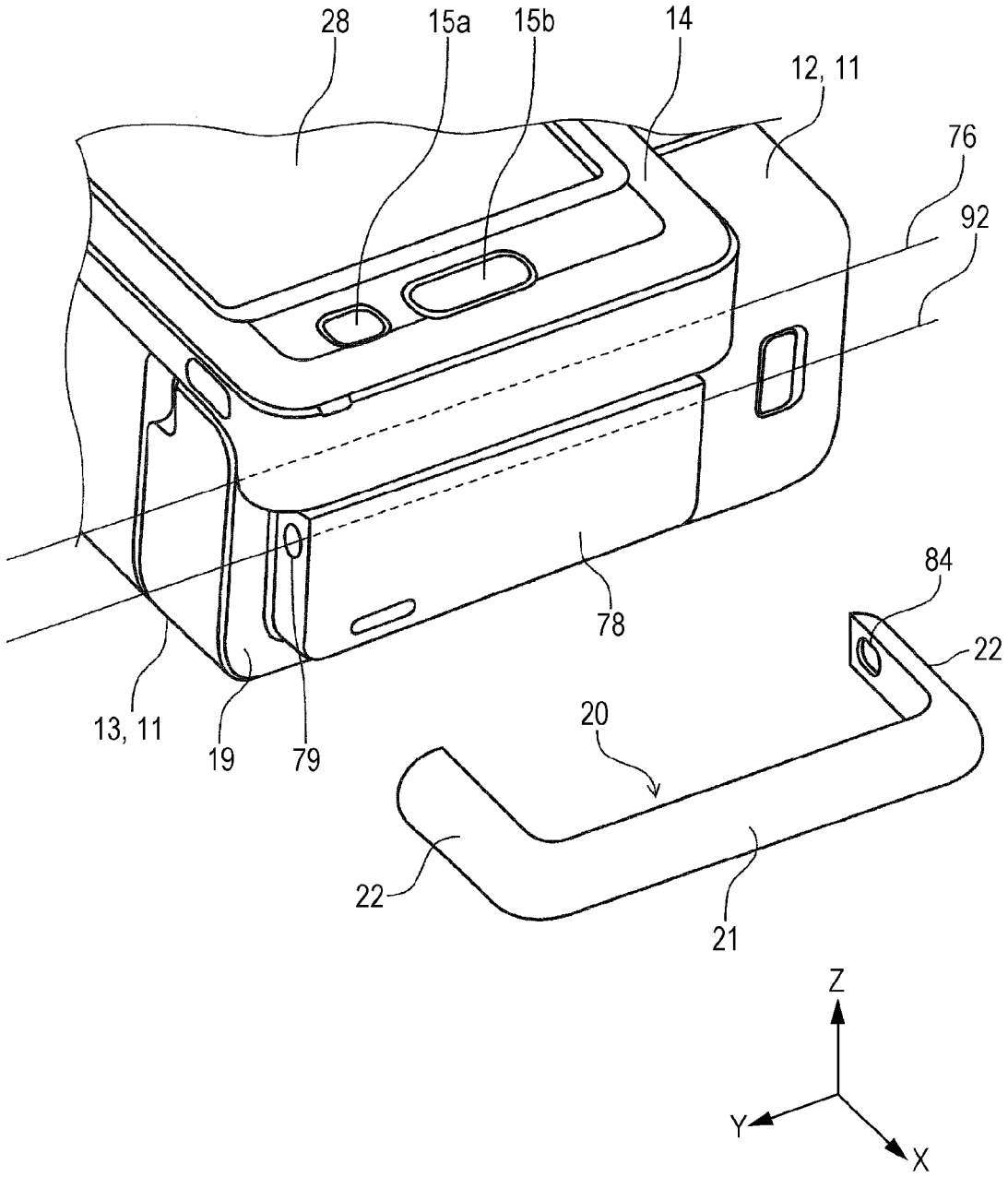
FIG. 6 is an exploded perspective view of portions of the printer.
Figure 7:
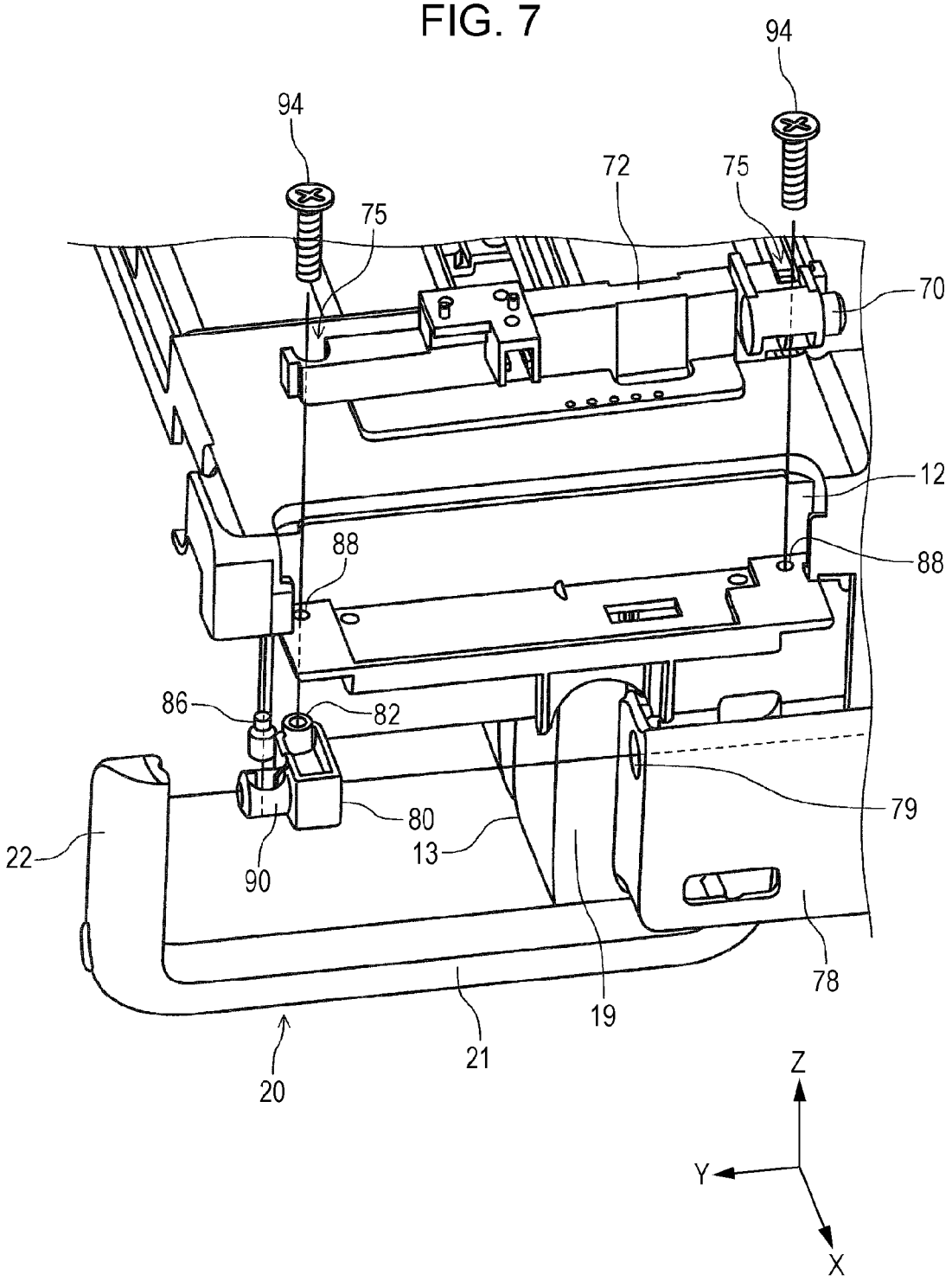
FIG. 7 is an exploded perspective view of portions of the printer.

FIG. 1A is a perspective view illustrating an apparatus main body of a printer according to an exemplary embodiment of the invention. FIG. 1B is a perspective view illustrating a state in which a handle of the printer shown in FIG. 1A is open. FIG. 2A is a perspective view representing a state in which a sheet feed cover and a sheet discharge cover of the printer shown in FIG. 1A are open. FIG. 2B is a perspective view illustrating a state in which the panel is further opened from the state shown in FIG. 2A. FIG. 3 is a sectional view of the printer shown in FIG. 2A, taken as indicated by arrows III and III. FIG. 4 is a sectional view of the printer shown in FIG. 1A, taken as indicated by arrows IV and IV. FIG. 5A is a perspective view of a panel and a hinge portion. FIG. 5B is a view illustrating a state in which the panel is attached to an apparatus main body portion of the printer. FIG. 6 is an exploded perspective view of portions of the printer. FIG. 7 is an exploded perspective view of portions of the printer.

Figure 8:
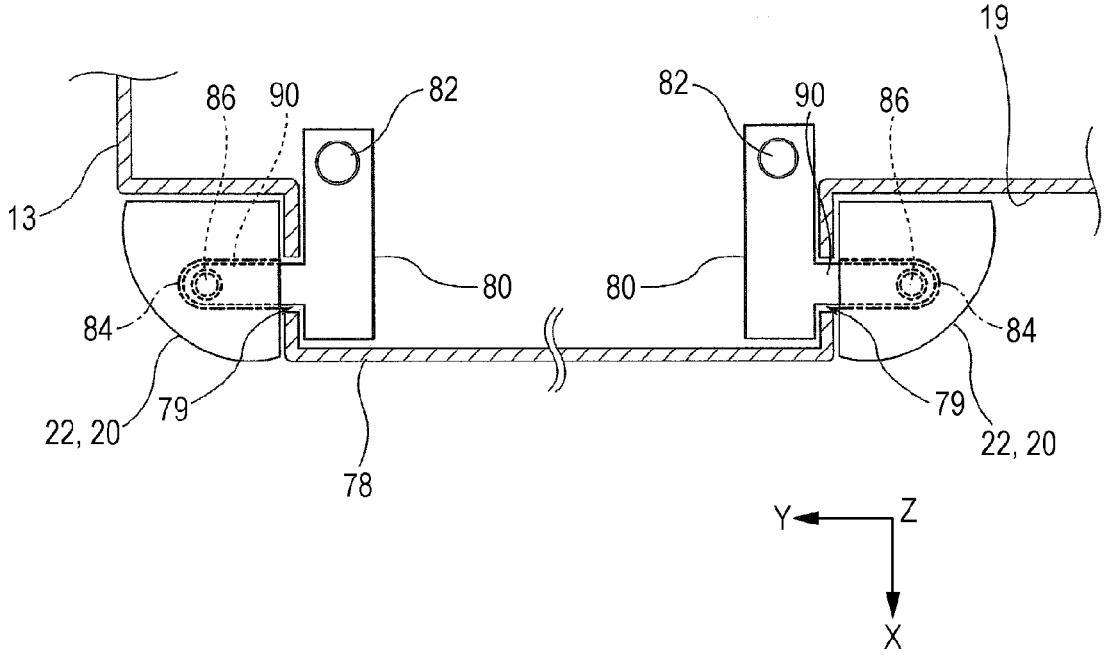
FIG. 8 is a sectional view of portions illustrating a handle attaching structure.
Figure 9B:
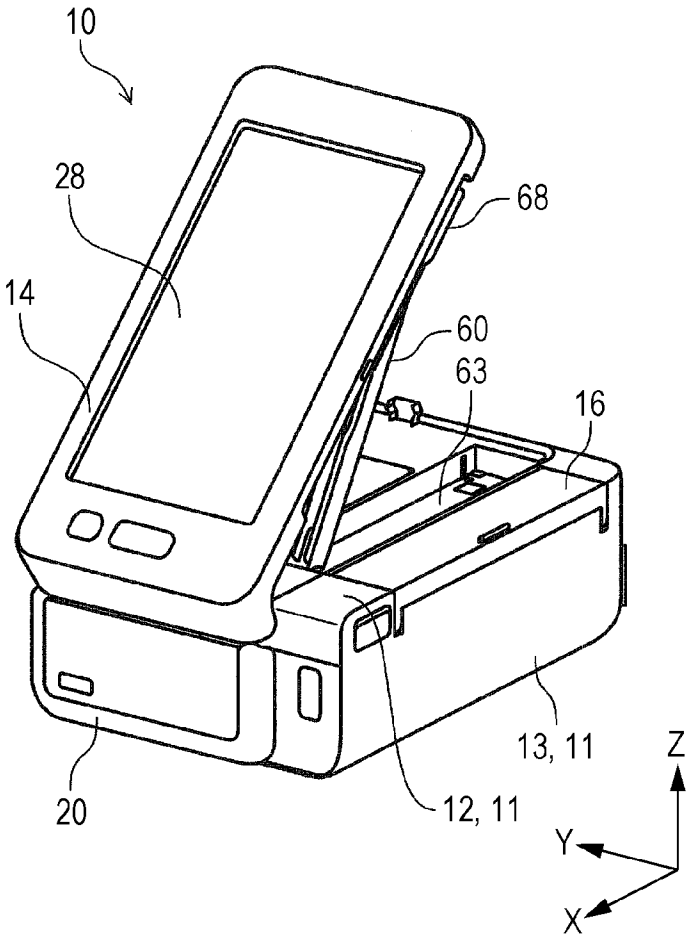
FIG. 9B is a perspective view representing a state in which the panel of the printer is between a closed state and a fully open state.
Figure 9A:
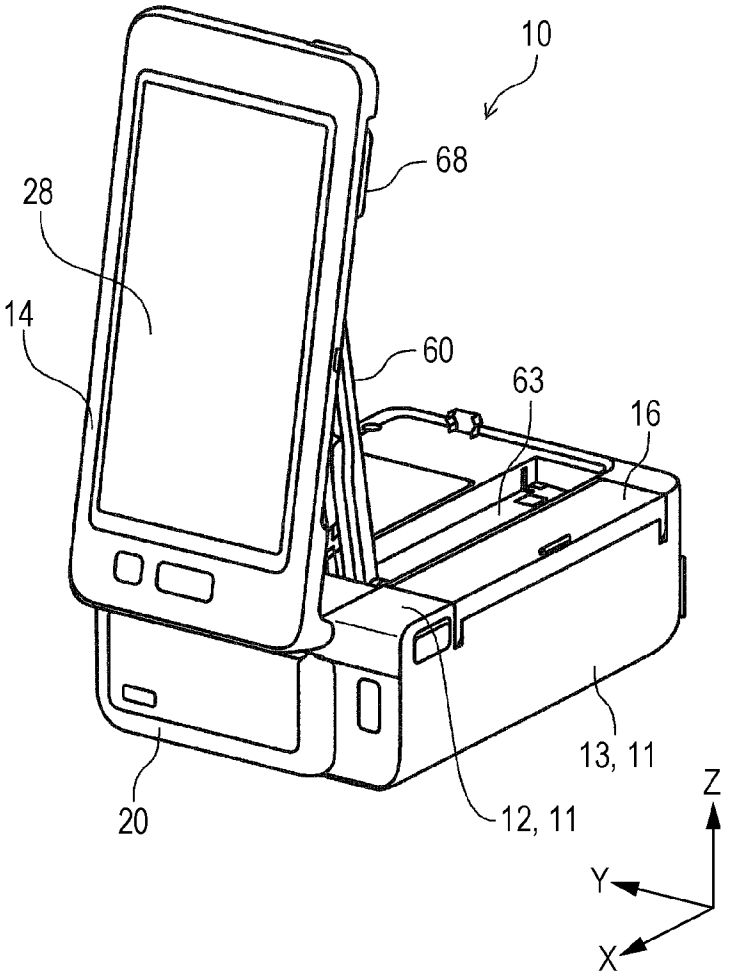
FIG. 9A is a perspective view representing an open state of the panel.
Figure 10B:
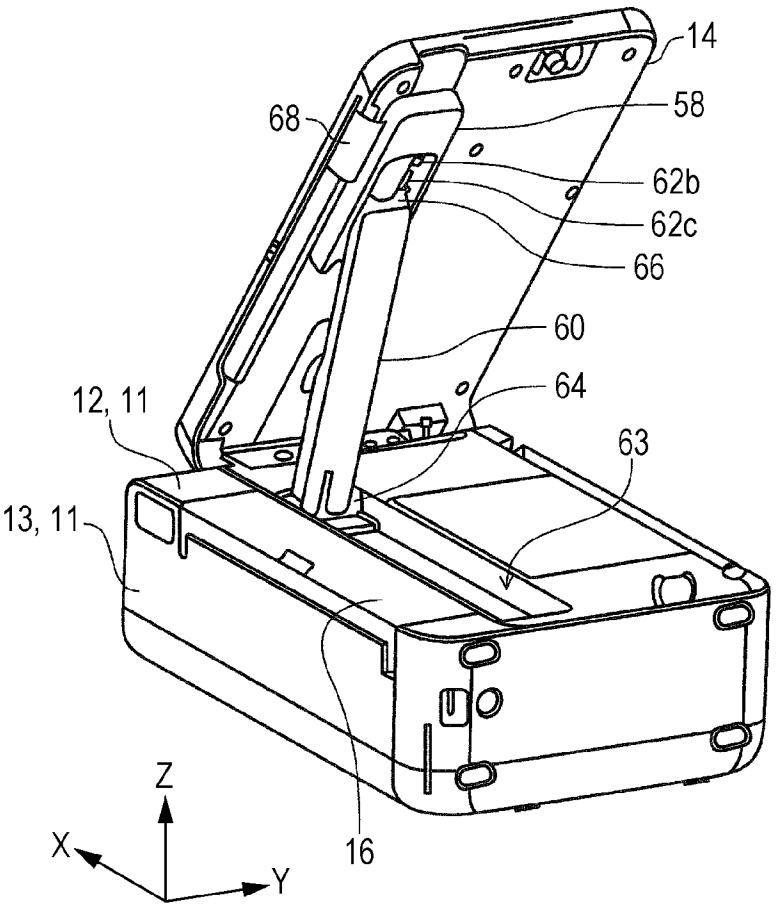
FIG. 10B is a perspective view of the printer taken from the back surface side of the panel.
Figure 10A:
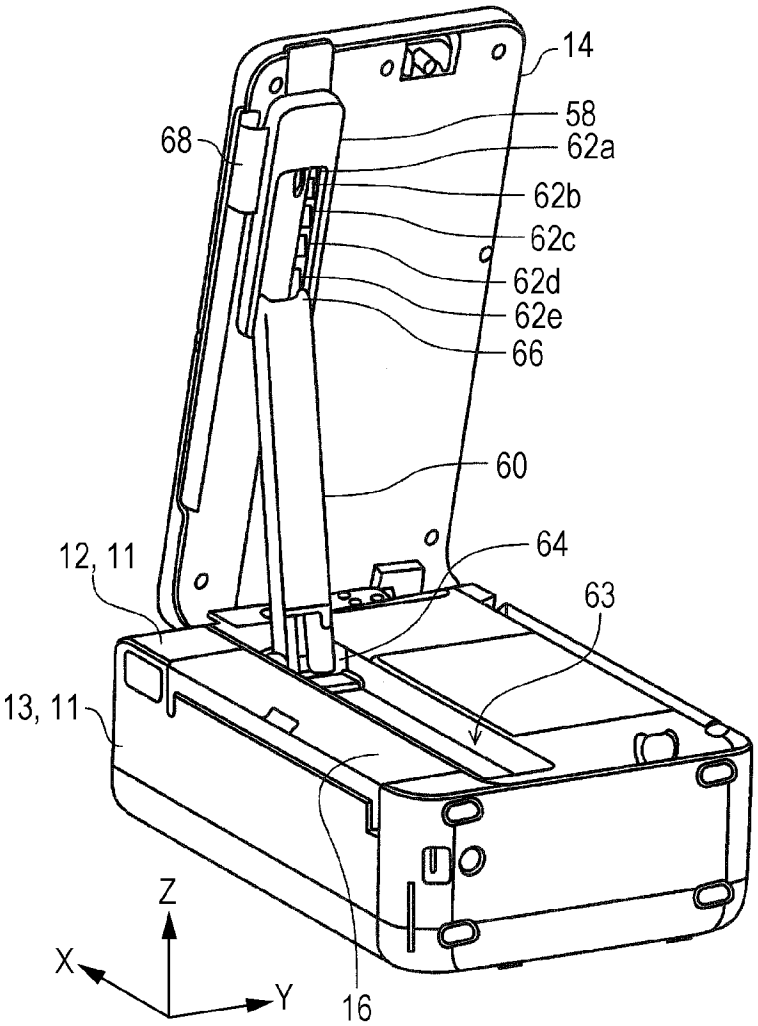
FIG. 10A is a perspective view of the printer taken from a back surface side of the panel.
Figure 11A:
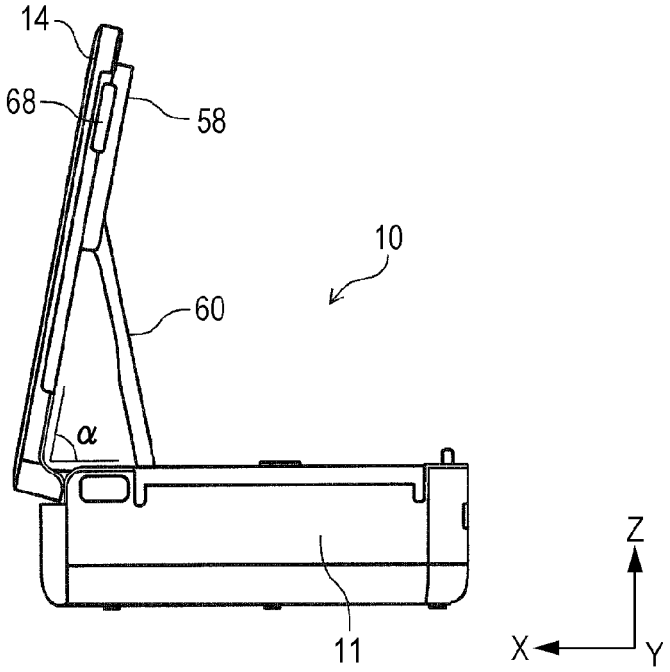
FIG. 11A is a view of the printer taken from a right side surface of the panel.
Figure 11B:
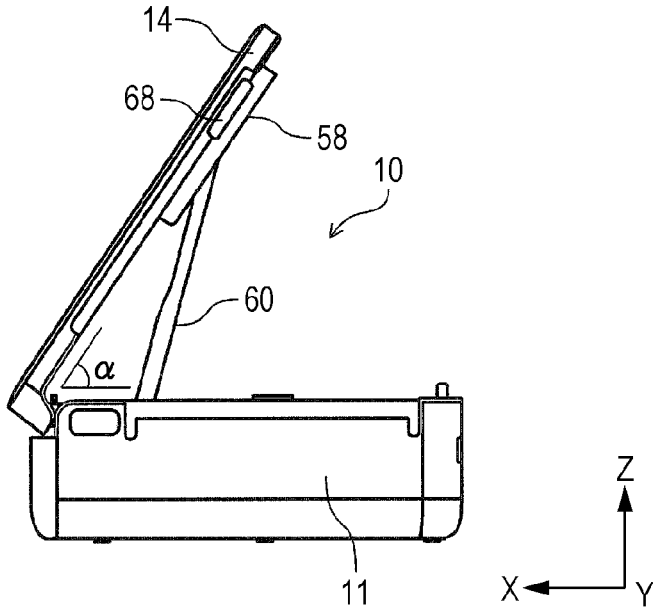
FIG. 11B is a view of the printer taken from the right surface side of the panel.
Figure 11C:
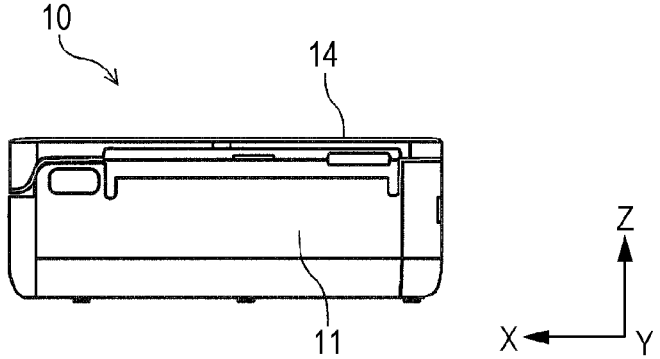
FIG. 11C is a view of the printer whose panel is in the closed state, taken from the right side surface of the panel.

FIG. 8 is a sectional view of portions illustrating a structure for attaching a handle. FIG. 9A is a perspective view representing an open state of the panel. FIG. 9B is a perspective view representing a state in which the panel of the printer is between a closed state and a fully open state. FIG. 10A is a perspective view taken from a back surface side of the panel shown in FIG. 9A. FIG. 10B is a perspective view taken from the back surface side of the panel shown in FIG. 9B. FIG. 11A is a view taken from a right side of the panel in FIG. 9A. FIG. 11B is a view taken form the right side of the panel in FIG. 9B. FIG. 11C is a view of the printer taken from the right side of the panel in a state in which the panel is closed.

Figure 12A:
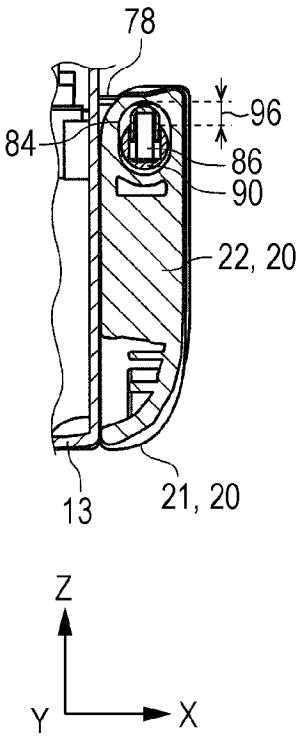
FIG. 12A is a view showing a state in which the handle is closed.
Figure 12B:
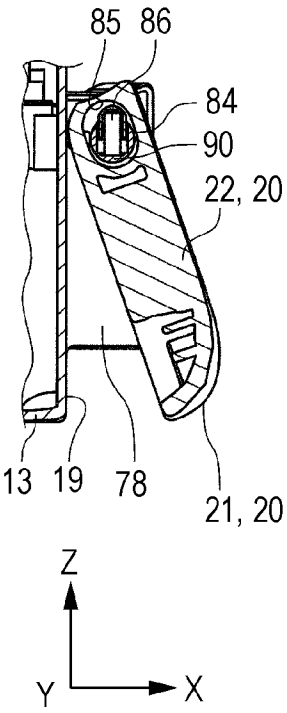
FIG. 12B is a view showing a state in which the handle is slightly open.
Figure 12C:
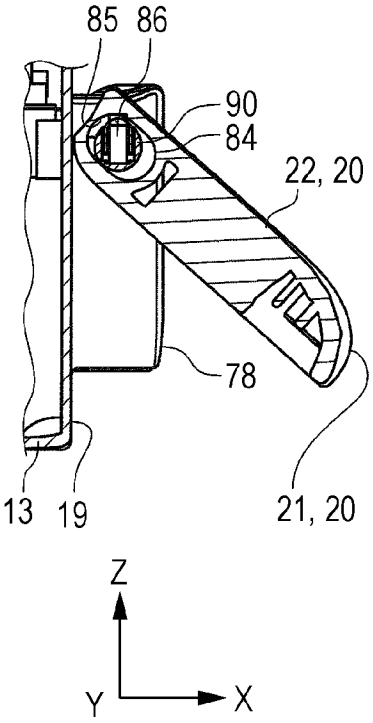
FIG. 12C is a view showing a state in which the handle is further opened.
Figure 12D:
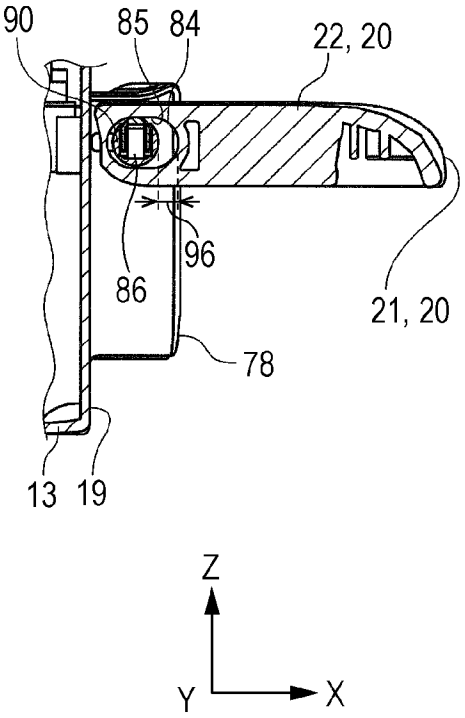
FIG. 12D is a view showing a state in which the handle is fully open (fully open state).
Figure 13A:
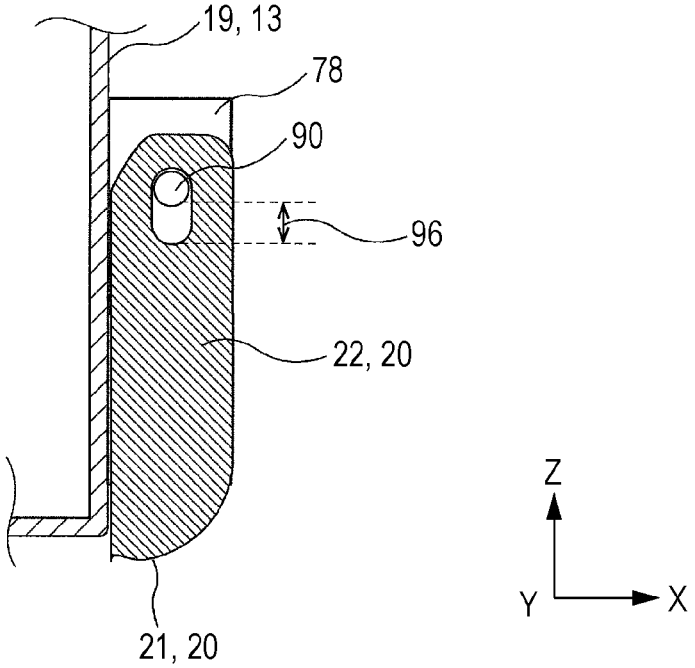
FIG. 13A is a sectional view of an arm portion of the handle.
Figure 13B:
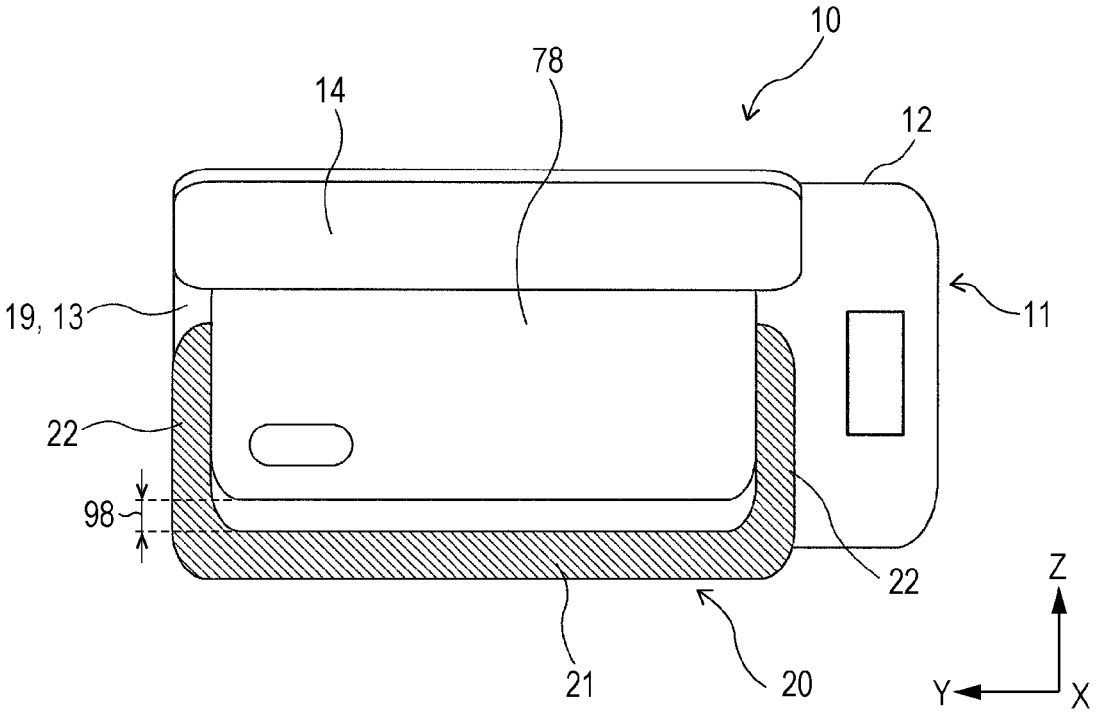
FIG. 13B is a view of the handle taken from a side surface side.
Figure 17:
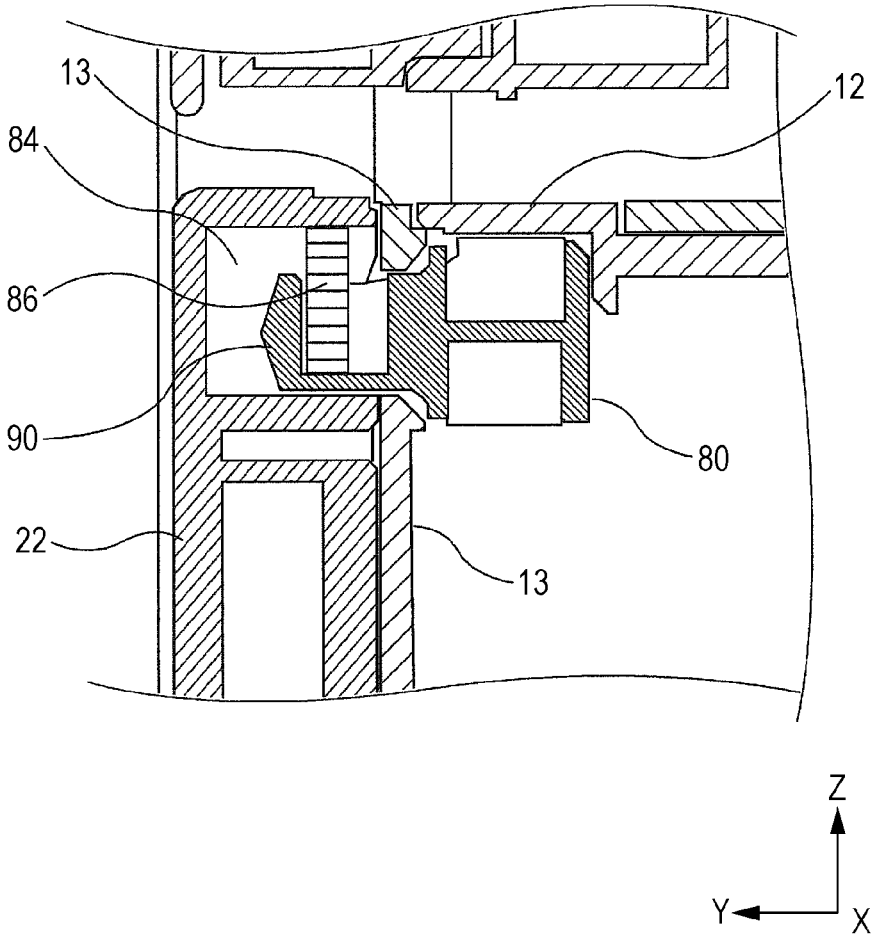
FIG. 17 is a vertical sectional view illustrating a handle attaching structure.
Figure 18:
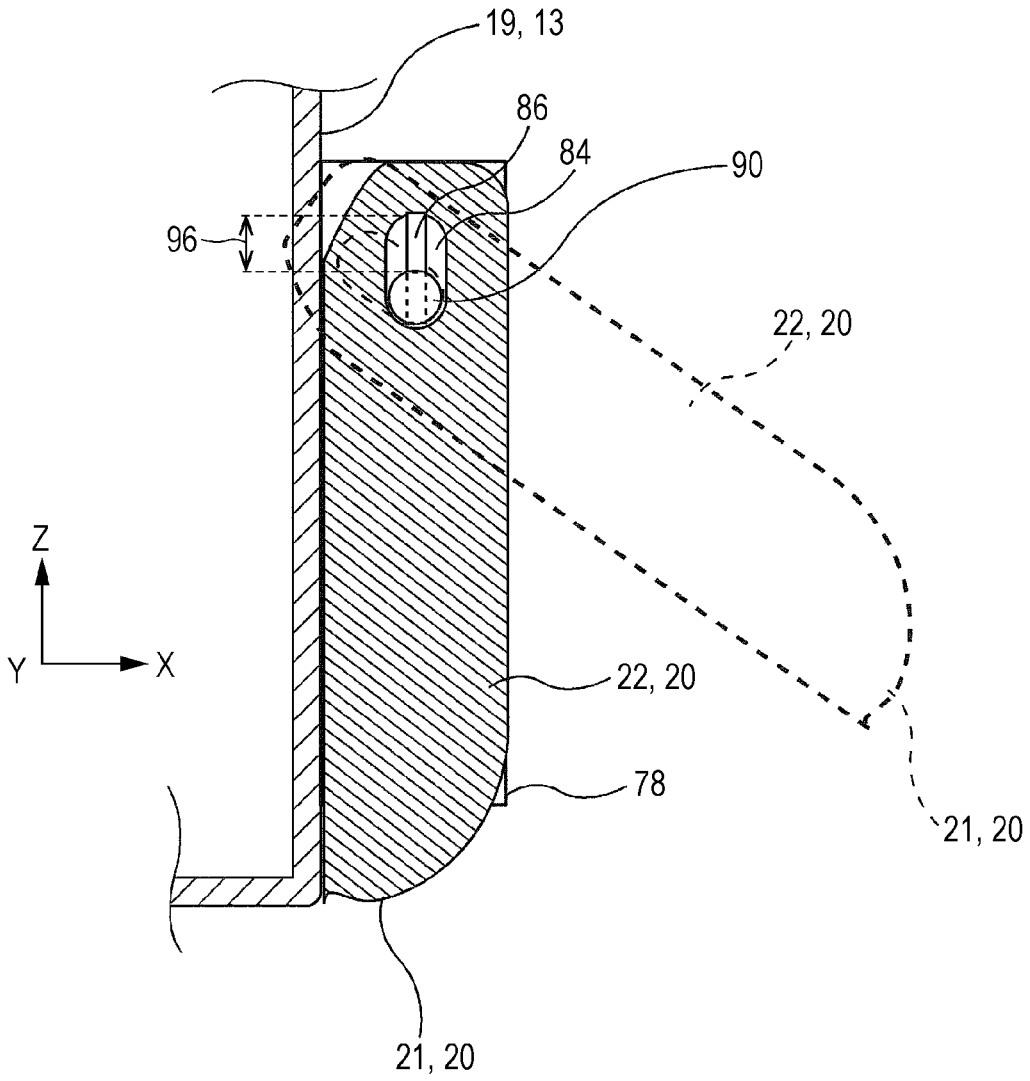
FIG. 18 is a diagram illustrating the pivoting of the handle.

FIGS. 12A to 12D are views representing the pivoting of the handle. FIG. 12A shows a state in which the handle is closed. FIG. 12B shows a state in which the handle is slightly opened. FIG. 12C shows a state in which the handle is further opened. FIG. 12D shows a state in which the handle is fully open. FIGS. 13A and 13B are views showing the position of the handle during a state in which the urging force of compressed springs has been released. FIG. 13A is a sectional view of an arm portion of the handle. FIG. 13B is a view of the handle taken from a positive X side. FIG. 17 is a vertical sectional view illustrating a structure for attaching the handle. FIG. 18 is a view illustrating the pivoting of the handle.

Overview of Printer

An ink jet printer 10 (hereinafter, referred to as "printer 10") as a recording apparatus according to the invention, as shown in FIG. 1A and FIG. 1B, includes an apparatus main body portion 11 of the printer 10, a panel 14 provided on an upper surface (positive Z-side surface) of the apparatus main body portion 11, a sheet feed cover 16 that opens and closes a rear side portion of the upper surface of the apparatus main body portion 11, a sheet discharge cover 18 that opens and closes a front surface (positive Y-side surface) side of the apparatus main body portion 11 in FIG. 1A, and a handle 20 provided pivotably relative to the apparatus main body portion 11. These portions and members form an exterior of the printer 10. The apparatus main body portion 11 includes a main body upper portion 12 (upper-side apparatus main body portion) that forms an upper portion of the apparatus main body portion 11 and a main body lower portion 13 (lower-side apparatus main body portion) that forms a lower portion of the apparatus main body portion 11.

Note that in an X-Y-Z coordinate system indicated in the diagrams, the directions of the X axis are scanning directions of a recording head and the directions of the Y axis are apparatus depth directions. The directions of the Z axis are along the gravity direction, that is, the apparatus height direction. Furthermore, a positive Y direction side is an apparatus front surface side, and a negative Y direction side is an apparatus back surface side. Furthermore, the right side in a view from the apparatus front surface side is defined as a side in a positive X direction and the left side in such a view is defined as a side in a negative X direction. Furthermore, a positive Z direction side is defined as being an apparatus' upper side (including an upper portion, an upper surface, etc.), and a negative Z direction side is defined as being an apparatus' lower side (including a lower portion, a lower surface, etc.).

At a position at the upper surface side of the printer 10 and near the apparatus back surface side there is provided a medium setting unit 23 in which sheets P as recording media are set as shown in FIG. 2A. The medium setting unit 23 is revealed by opening the sheet feed cover 16. The sheets P set in the medium setting unit 23 are supported by a sheet support portion 26 made up of a first slide plate 24*a* and a second slide plate 24*b*. Note that the first slide plate 24*a* and the second slide plate 24*b* are constructed so that the first and second slide plates 24*a* and 24*a* can be retracted into a housing portion 26 (see FIG. 3) that is provided in the apparatus main body portion 11 and can be drawn out of the housing portion 26.

Furthermore, at the apparatus front surface side there is provided a sheet discharge unit 41 (sheet discharge opening) to which a sheet P having undergone recording is discharged. The sheet discharge unit 41 is revealed by opening the sheet discharge cover 18. The sheet discharge cover 18 in the open state functions as a tray that supports the sheet P discharged from the apparatus main body portion 11.

The panel 14 has on an upper surface side thereof a display unit 28 that displays various information and the like. The panel 14 is pivotable about a pivot shaft provided at a positive X-side side surface (shown in FIG. 4 and referred hereinafter as "first pivot shaft 70") so as to open and close an upper portion of the apparatus main body portion 11 of the printer 10 (see FIG. 2A and FIG. 2B).

Furthermore, in this exemplary embodiment, a pivot shaft of the handle 20 (hereinafter, referred to as "second pivot shaft 90") is also provided at the positive X-side side surface (see FIG. 1A and FIG. 1B). The handle 20 is a carry handle to grasp in order to carry the printer 10. The constructions of the panel 14 and the handle 20 will be described in detail later.

Next, with reference to FIG. 3 and FIG. 4, an overall internal construction of the printer 10 and a transport path of the sheet P will be described. FIG. 3 shows the transport path of the sheet P. In the printer 10, the sheet P is transported in the positive Y direction in FIG. 3. Note that in the following description, the direction (positive Y direction side) in which the sheet P is transported in the printer 10 will be indicated by the term "downstream" and the opposite direction (negative Y direction side) will be indicated by the term "upstream".

Inside the apparatus main body portion 11 there is a carriage 32 provided with a recording head 30 that performs recording by ejecting ink onto the sheet P. The carriage 32 is configured to move back and forth in directions (directions of the X axis) that intersect the sheet transport direction (positive Y direction). A bottom surface of the recording head 30 is provided with a nozzle array made up of a plurality of nozzles (not shown in the drawings) that eject ink onto the sheet P transported below the recording head 30. The ink is supplied via the nozzles from a liquid container 34 that is mounted on the carriage 32.

The sheet P is fed downstream in the sheet transport direction by the sheet feed roller 36. The sheet P sent by the sheet feed roller 36 is transported into a recording region below recording head 30 (at the negative Z direction side thereof) in a state in which the sheet P is pinched by a transport roller pair 38 that includes a transport driving roller 38*a* and a transport driven roller 38*b*.

At a side facing the recording head 30 (a side below the recording head 30 in FIG. 3) there is provided a support member 42 that defines a sheet gap between the sheet P and a liquid ejection surface (bottom surface) of the recording head 30. Recording is executed by ejecting ink from the recording head 30 onto the sheet P between the recording head 30 and a support member 42.

At the downstream side of the recording head 30 in the sheet transport direction there is provided a sheet discharge roller pair 46 that includes a driving sheet discharge roller 44*a* and a driven sheet discharge roller 44*b*. A rotating body 48 may be provided as a float preventer between the recording head 30 and the sheet discharge roller pair 46. The rotating body 48 is provided on the transport path of the sheet P from the recording head 30 to the sheet discharge roller pair 46 so as to be passively rotated in contact with a recording surface of the sheet P. Therefore, the rotating body 48 performs a function of preventing the sheet P from floating off from the support member 42 and keeping a constant distance between the sheet P and the recording head 30.

The sheet P having undergone recording is transported over the support member 42 and is further sent downstream by the sheet discharge roller pair 46 so as to be discharged from a sheet discharge unit 41 onto a sheet discharge cover 18 in the open state.

The internal structure of the printer 10 and the sheet transport path thereof are generally as described above.

Next, the foregoing panel 14 will be further described in detail.

The panel 14 having the display unit 28 on its upper surface side has a configuration whose outer perimeter has two short sides 50 and two long sides 52 as shown in FIG. 1A. In this exemplary embodiment, the panel 14 has a rectangular shape whose four corners are rounded.

An outline of the display unit 28 has a shape that includes two short sides 54 and two long sides 56. The display unit 28 is provided in the panel 14 so that the longitudinal directions of the display unit 28 (the directions of the long sides 56) coincide with the longitudinal direction of the panel 14 (the directions of the long sides 52). The size of the display unit 28 is equal to or larger than the postcard size.

In this exemplary embodiment, the display unit 28 functions as a so-called touch panel that detects the location on the display unit 28 at which pressure is applied. The display unit 28 is capable of displaying various information, such as contents of editing, contents of print setting, current operation status, etc., and is also capable of executing various input operations.

The panel 14 is constructed to be pivotable about the first pivot shaft 70 (see FIG. 4 and the like) so as to open an upper portion of the apparatus main body portion 11. A direction of the first pivot shaft 70 about which the panel 14 pivots intersects the longitudinal directions of the panel 14.

More specifically, the first pivot shaft 70 is provided in a side surface portion of the apparatus main body portion 11 which faces a direction that intersects the sheet transport direction (a positive X-side side surface portion of the apparatus main body portion 11). The first pivot shaft 70 is provided in such a direction that when the apparatus main body portion 11 is placed with the panel 14 in the open state standing at the near side, the sheet transport direction is along the left-right directions (the Y-axis directions) as shown in FIG. 2B. In other words, the first pivot shaft 70 is provided so as to become a right side surface of the apparatus main body portion 11 when the apparatus main body portion 11 is placed with the sheet discharge unit 41 side (the positive Y side) being at the near side.

The panel 14 is connected to the main body lower portion 13 that constitutes the apparatus main body portion 11, via a hinge portion 72 (see FIGS. 5A, 5B and 7) that includes the first pivot shaft 70. The panel 14 has bearing portions 74 that receive the first pivot shaft 70. A structure for attaching the panel 14 to the apparatus main body portion 11 will be described below together with a structure for attaching the handle 20.

Next, a construction for holding the panel 14 in the open state will be described with reference to FIGS. 9A to 11C.

As shown in FIGS. 10A and 10B, the panel 14 has, at a reverse side of the display unit 28 (hereinafter, sometimes referred to as "back surface of the panel 14"), an arm 60 that keeps the panel 14 in the open state by engaging with the panel 14.

The arm 60 is pivotable in the same directions as the panel 14 about a pivot shaft that is provided on an end portion of the arm 60 and set on a bearing 64 provided on the main body upper portion 12. A second end portion of the arm 60 is slidably connected to the back surface of the panel 14. The second end portion of the arm 60 is slidable relative to a slide portion 58 that is provided in the longitudinal directions of the panel 14. The second end portion of the arm 60 has an engaging portion 66 that is engageable with each one of a plurality of engaged portions 62 (62*a*, 62*b*, 62*c*, 62*d*, 62*e*) that are provided in the slide portion 58 (see FIG. 10A).

The plurality of engaged portions 62 are provided in sliding directions of the arm 60, that is, the longitudinal directions of the panel 14. By changing the engaged portion 62 with which the engaging portion 66 is engaged from one engaged portion to another as shown in FIGS. 10A and 10B, the angle of aperture of the panel 14 (angle $\alpha$ indicated in FIGS. 11A and 11B) can be changed so that an inclined posture of the panel 14 can be maintained. That is, the panel 14 can be adjusted to an angle $\alpha$ of aperture that facilitates the user's operations.

For example, in FIG. 9A, FIG. 10A, and FIG. 11A, the engaging portion 66 is engaged with the engaged portion 62*e*, and the panel 14 is fully open (fully open state). In FIG. 9B, FIG. 10B, and FIG. 11B, the engaging portion 66 is engaged with the engaged portion 62*c*, and the panel 14 is in a state between the fully open state and a closed state. When the engaging portion 66 is engaged with the engaged portion 62*a*, the panel 14 is in the closed state as shown in FIG. 11C. By increasing the number of engaged portions 62, finer adjustment can be achieved.

Note that the arm 60 is urged by an urger (not shown) in a direction in which the engaging portion 66 is engageable with the engaged portions 62. A side portion of the slide portion 58 is provided with an engagement release button 68 for releasing the engagement of the engaging portion 66 with any one of the engaged portions 62. The engagement release button 68 may be provided above the slide portion 58.

In this exemplary embodiment, the arm 60 is provided to be positioned between the medium setting unit 23 and the carriage 32 in the sheet transport direction (Y axis direction) (see FIG. 3). The arm 60 is housed in an arm housing portion 63 of the main body upper portion 12 when the panel 14 is closed. This construction makes it possible to efficiently use the region between the medium setting unit 23 and the carriage 32 and restrain a size increase of the apparatus.

Furthermore, in this exemplary embodiment, as represented in FIG. 3, at least a portion of the arm 60 and at least a portion of the carriage 32 are at the same height position in the apparatus height direction (Z axis direction). That is, at least a portion of the arm 60 and at least a portion of the carriage 32 overlap each other in the height direction. This construction makes it possible to minimize the apparatus measurement in the height direction and achieve a size reduction of the apparatus.

Due to the construction in which the panel 14 is opened and closed by pivoting the panel 14 about the first pivot shaft 70 whose direction intersects the longitudinal directions of the panel 14 and the display unit 28, the following operation and effects can be achieved.

Due to the foregoing construction, when the panel 14 is opened as shown in FIG. 2B, the longitudinal directions of the display unit 28 are along the vertical up-down directions in a view from a user facing the panel 14. Therefore, in a use for creation of a postcard for which the vertical orientation is adopted, the display region of the display unit 28 can be utilized to a maximum extent so that edited images can be displayed in increased sizes. Thus, the editing operation is more facilitated and users' needs can be more appropriately met.

Since the size of the display unit 28 is equal to or larger than the postcard size, edited images during postcard creation can be displayed in actual size in the display unit 28, so that the edited images displayed are closer to actual completed images.

Furthermore, when the user is to operate the panel 14, the user usually places the apparatus main body portion 11 with the open panel 14 standing on the near side. When the apparatus main body portion 11 is placed in this manner, the sheet transport direction is along the left-right directions, so that the sheet discharge cover 18 does not interfere with the user operating the panel 14. Thus, the operability of the panel 14 improves.

Furthermore, in this exemplary embodiment, the panel 14, when in the closed state, covers an entire region in the upper surface of the apparatus main body portion 11 in the direction that intersects the sheet transport direction (i.e., in the X axis direction). Due to this, when the panel 14 is closed, the apparatus main body portion 11 and the panel 14 appear more integrated, so that the printer 10 improves in terms of the design characteristic and the beauty of the external appearance.

Incidentally, the printer 10 can be operated not only by the touch panel type display unit 28 but also by, for example, an operation button 15*a* and an operation button 15*b* provided on the panel 14 (see FIG. 1). Furthermore, the printer 10 can also be operated on the basis of input from another appliance, such as a keyboard, connected to the printer 10. The connection between the printer 10 and other appliances may be wireless connection, such as infrared communication, or connection by wire.

Furthermore, the printer 10 is capable of executing sheet feed/discharge operation and recording operation in a state in which the panel 14 is open.

Furthermore, between the first pivot shaft 70 and the bearing portion 74 there may be provided, for example, a known free stop mechanism capable of making the panel 14 stand still at any angle by generating a torque when the panel is opened or closed. This arrangement will realize the even smoother opening and closing of the panel 14.

Attaching Structures for Panel and Handle

Next, examples of the attaching structures for the panel 14 and the handle 20 will be described.

As described above, the panel 14 is attached to the apparatus main body portion 11 that includes the main body upper portion 12 and the main body lower portion 13, via the hinge portion 72 (see FIGS. 5A and 5B and FIG. 7).

The first pivot shaft 70 of the panel 14, as shown in FIG. 4, is provided at the positive X-side side surface of the apparatus main body portion 11. At a location below the first pivot shaft 70 and close to the positive X-side side surface there is provided a pivot shaft (second pivot shaft 90) of the handle 20. Note that a pivot axis 76 of the first pivot shaft 70 and a pivot axis 92 of the second pivot shaft 90 positioned under the first pivot shaft 70 are substantially parallel to each other as shown in FIG. 6.

In the exemplary embodiment, attaching members 80 for attaching the handle 20 to the apparatus main body portion 11 (main body lower portion 13) are provided. The hinge portion 72, the main body upper portion 12, and the main body lower portion 13 are fixed to the attaching members 80.

This attaching structure will be further described in detail below.

The panel 14 includes the bearing portion 74 (see FIG. 5A), and the first pivot shaft 70 of the hinge portion 72 is pivotably supported by the bearing portion 74. The hinge portion 72 is attached to the apparatus main body portion 11 (see FIGS. 5B and 7). Thus, the panel 14 is opened and closed to reveal and cover the upper portion of the apparatus main body portion 11. A hinge portion cap 70 is provided over the hinge portion 72.

The handle 20 (see FIG. 6) has a substantially square U shape made up of a grip portion 21 that extends substantially in a depth direction of the apparatus main body portion 11 (the Y axis direction) and two arm portions 22 that are provided on two opposite ends of the grip portion 21 and that extend in a direction that intersects the direction of the grip portion 21.

Furthermore, as shown in FIG. 6, a positive X-side side surface 19 of the main body lower portion 13 is provided with a protruded portion 78 that is protruded from the side surface 19 to the positive X side. The handle 20 is pivotably attached to the protruded portion 78 via the attaching members 80 that each have the second pivot shaft 90 (see FIGS. 7, 8 and 17).

More concretely, end portions of the two opposite-side arm portions 22 of the handle 20 each have a recess portion 84 (see FIGS. 6, 8 and 17) that receives a corresponding one of the second pivot shafts 90. As shown in FIG. 8, the second pivot shafts 90 of the attaching members 80 are inserted from inside the protruded portion 78 into attachment holes 79 formed in the protruded portion 78 of the main body lower portion 13. The second pivot shafts 90 thus extending through the attaching holes 79 are received by the recess portions 84 of the handle 20.

Each of the two attaching members 80 has a fastening hole 82, the hinge portion 72 has first through holes 75 that correspond to the fastening holes 82, and the main body upper portion 12 has second through holes 88 that also correspond to the fastening holes 82, as shown in FIG. 7. Screws 94 are inserted through the first through holes 75 and the second through holes 88 and are fastened to the fastening holes 82 of the attaching members 80. Thus, the hinge portion 72, the main body upper portion 12, and the main body lower portion 13 are fixed to the attaching members 80.

Since the hinge portion 72 to which the panel 14 is connected, the main body upper portion 12, and the main body lower portion 13 are fixed to the attaching members 80 by which the handle 20 is attached to the apparatus main body portion 11 (main body lower portion 13) as described above, the panel 14 is supported by four different members, that is, the hinge portion 72, the main body upper portion 12, the main body lower portion 13, and the attaching member 80 (the two attaching members 80 in this exemplary embodiment) of the handle 20. Thus, the load on the panel 14 can be dispersed to the four different members. Due to this construction, the attaching structure for attaching the panel 14 to the apparatus main body portion 11 can be given high strength.

In other words, when the printer 10 is held by using the handle 20 as a carry handle, the handle 20 supports the panel 14, the main body upper portion 12, and the main body lower portion 13 via the attaching members 80. Therefore, the printer 10 can be carried reliably with a reduced risk of damaging the printer 10, compared with a printer having a construction in which all the load of the printer is borne by a handle 20 only via a main body lower portion 13.

Note that the upper surface of the apparatus main body portion 11 of the printer 10 changes between when the printer 10 is in a state for recording (e.g., the state shown in FIG. 2A) and when the printer 10 is a state for carrying the printer 10 by grasping the handle 20 (e.g., the state shown in FIG. 1B). The first pivot shafts 70 and the second pivot shafts 90 are provided at a surface side (i.e., the positive X side) of the apparatus main body portion 11 which is a side surface side of the printer 10 when the printer 10 is in the state for recording.

Furthermore, since the protruded portion 78 is formed on the side surface 19 of the main body lower portion 13, the rigidity of the side surface of the main body lower portion 13 can be improved. Because the attaching members 80 for the handle 20 are attached to the site having an increased rigidity (the protruded portion 78), the attaching structure for the panel 14 can be given even higher strength, and the risk of damaging the apparatus main body portion 11 when the recording apparatus (the printer 10) is carried by grasping the handle 20 can be inhibited.

Furthermore, since the first pivot shafts 70, which is the pivot shaft of the panel 14, and the second pivot shafts 90, which is the pivot shaft of the handle 20, are provided at the same side surface side of the apparatus main body portion 11, it is possible to avoid an incident in which the panel 14 is unintentionally opened when the printer 10 assumes a posture as shown in FIG. 1B when the handle 20 is grasped to carry the printer 10 (recording apparatus). This makes it possible to secure a more appropriate portability of the printer 10 while realizing an increased size of the display unit 28 of the panel 14.

Other Constructions Regarding the Handle

Other constructions regarding the handle 20 will be described with reference to the drawings.

In this exemplary embodiment, the handle 20 in the closed state is retracted so as to lie along the perimeter of the protruded portion 78 and not to be protruded outward from the side surface 19 of the main body lower portion 13. Thus, the handle 20 in the closed state and the protruded portion 78 form a side surface of the printer 10. Therefore, when the handle 20 is folded from a carrying state (FIG. 1B), the handle 20 does not protrude from the apparatus main body portion 11 but appears integrated with the apparatus main body portion 11. Thus, the external beauty of the printer 10 improves.

The recess portions 84 that are provided on the arm portions 22 of the handle 20 and that receive the second pivot shafts 90 of the attaching members 80 are provided with an allowance 96 that permits the handle 20 to move in directions that intersect the pivot axis direction (Y axis direction) when the handle 20 is in the closed state (see, e.g., FIG. 13A).

More concretely, each recess portion 84, as shown in FIG. 13A, has a vertically elongated shape in a view from the pivot axis direction of the second pivot shaft 90 (from the Y axis direction) during the closed state of the handle 20. The width of the recess portions 84 along the short sides (the width thereof in the X axis direction shown in FIG. 13A) corresponds to the thickness (diameter) of the second pivot shafts 90.

Then, the second pivot shaft 90 of each attaching member 80 is provided with a compressed spring 86 as an urger (urging member) that exerts an urging force in the positive Z direction. Therefore, when the handle 20 is in the closed state (FIG. 12A), the allowance 96 between each recess portion 84 and a corresponding one of the second pivot shafts 90 is filled (i.e., eliminated) due to the urging force of the compressed spring 86.

Note that in the case where the allowance 96 between each recess portion 84 and the corresponding second pivot shaft 90 is not eliminated by the compressed spring 86, the handle 20 hangs by gravity from the second pivot shafts 90 when the handle 20 is closed as in a state shown in FIG. 13A. More specifically, in each recess portion 84, the second pivot shaft 90 is positioned in an upper side of the recess portion 84 (a side remoter from the grip portion 21), and the allowance 96 is formed in a lower side of the recess portion 84.

At this time, as shown in FIG. 13B, a gap 98 is formed between the grip portion 21 of the handle 20 and the protruded portion 78. In this state, a portion of the grip portion 21 of the handle 20 is protruded downward from a bottom surface of the main body lower portion 13 (to the negative Z side).

However, as in FIG. 12A, when the handle 20 is closed, the allowance 96 between each recess portion 84 and the second pivot shaft 90 can be eliminated due to the urging force of the compressed spring 86 so that the handle 20 is raised and therefore the gap 98 (FIG. 13B) between the handle 20 and the protruded portion 78 is eliminated.

When the handle 20 is pivoted in the opening direction by displacing the grip portion 21 upward (to the positive Z side) from a lower position (the negative Z side) assumed when the handle 20 is closed, an end edge 85 of each recess portion 84 presses the corresponding compressed spring 86 as shown in FIGS. 12B to 12D, so that the allowance 96 is formed between each recess portion 84 and the corresponding second pivot shaft 90.

Because there is provided an allowance that permits the handle 20 to move in directions that intersect the pivot axis direction of the handle 20 (the Y axis direction) (i.e., to move in directions that contain a component of the X axis direction) when the handle 20 is opened, the relative position of the second pivot shafts 90 to the handle 20 changes when the handle 20 is opened from the closed state. Concretely, the position of the second pivot shafts 90 in the recess portions 84 relatively shifts from a position closer to the grip portion 21 to a position remoter from the grip portion 21.

That is, as the handle 20 is turned from the closed state to the open state, the handle 20 shifts from a position close to the side surface 19 of the main body lower portion 13 (the position shown in FIG. 12A) to a side away from the side surface 19 (to the positive X direction side) (see FIGS. 12B to 12D).

For example, as shown in FIG. 18, if the handle 20 is to be opened without changing the relative position of the second pivot shafts 90 to the handle 20 (the position of the second pivot shafts 90 in the recess portions 84) (as indicated by an imaginary line), an end portion of each arm portion 22 of the handle 20 interferes with the side surface 19 of the main body lower portion 13. Therefore, in the case where the relative position of the second pivot shafts 90 to the handle 20 remains unchanged, each second pivot shaft 90 needs to be provided at a position apart from the side surface 19 of the main body lower portion 13 (a position to the positive X side), so that a gap is formed between the handle 20 in the closed state and the side surface 19 of the main body lower portion 13.

In the exemplary embodiment, however, each recess portion 84 is provided with the allowance 96, and the gap 98 (FIG. 13B) between the handle 20 in the closed state and the protruded portion 78 is eliminated due to the urging force of the compressed springs 86 (urgers). Therefore, the handle 20 shifts to the side away from the main body lower portion 13 (to the positive X direction side) as the handle 20 is turned to the open state. Hence, it becomes possible to avoid interference of the handle 20 with the side surface 19 of the main body lower portion 13 at the time of opening the handle 20 and to close the handle 20 without forming a gap between the handle 20 and the side surface 19 of the main body lower portion 13. Accordingly, the beauty of the side surface of the printer 10 can be further improved.

The pivot range of the panel 14 (see FIGS. 11A to 11C) and the pivot range of handle 20 (see FIGS. 12A to 12D) are set in such a positional relation that the pivoting movements of the panel 14 and the handle 20 do not interfere with each other. This improve the operability of the panel 14 and the handle 20. That is, the panel 14 and the handle 20 can be pivoted independently of each other. Note that in this exemplary embodiment, since the allowance 96 permits the handle 20 to move a predetermined amount in directions that intersect the pivot axis direction of the handle 20 (the Y axis direction), the panel 14, if the handle 20 should interfere with the panel 14, will not inhibit the pivoting of the handle 20. Likewise, if the panel 14 should interfere with the handle 20, the handle 20 will shift so as to avoid inhibiting the pivoting of the panel 14.

Other Constructions of the Printer

Next, other constructions of the printer 10 will be described.

Figure 14A:
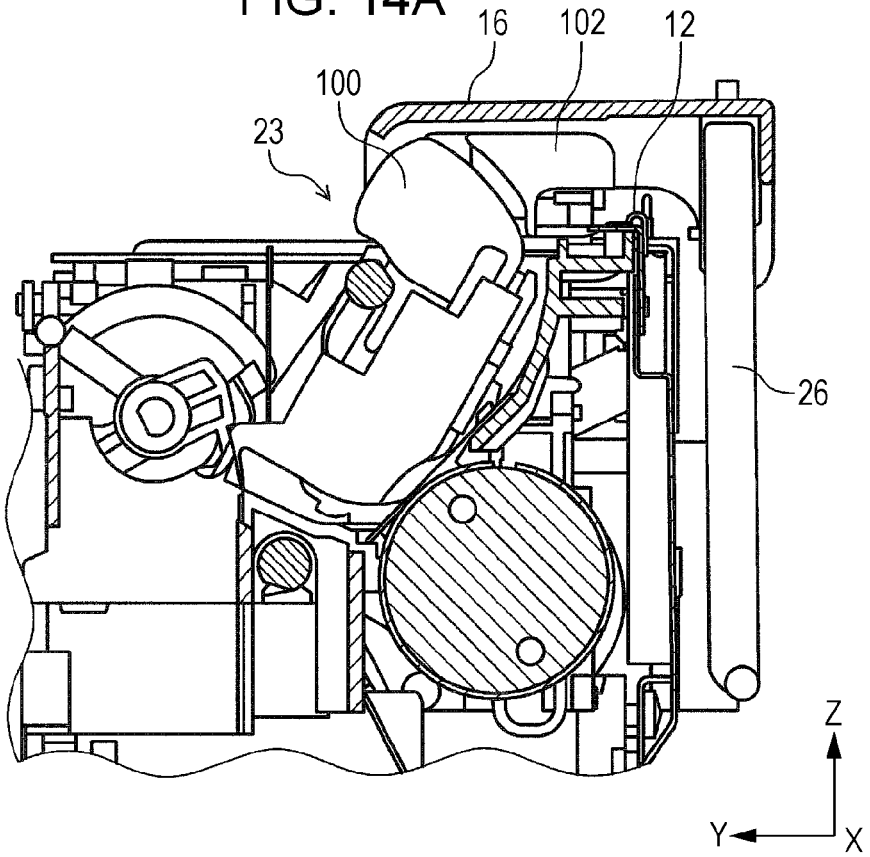
FIG. 14A is a sectional view of portions of the printer, showing a state in which the sheet feed cover is closed.
Figure 14B:
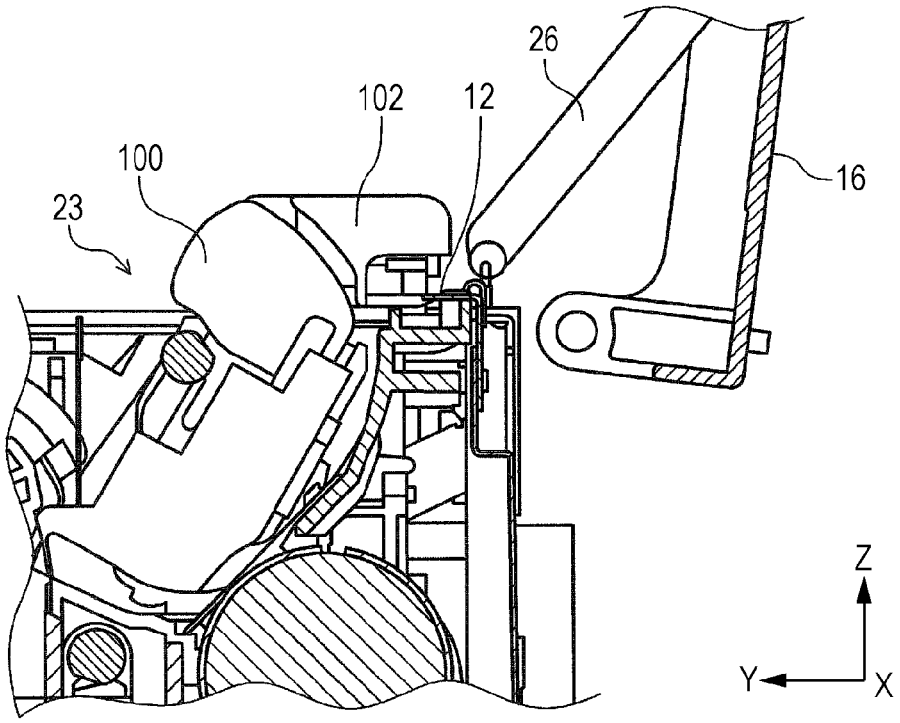
FIG. 14B is a sectional view of portions of the printer, showing a state in which the sheet feed cover is open.
Figure 15:
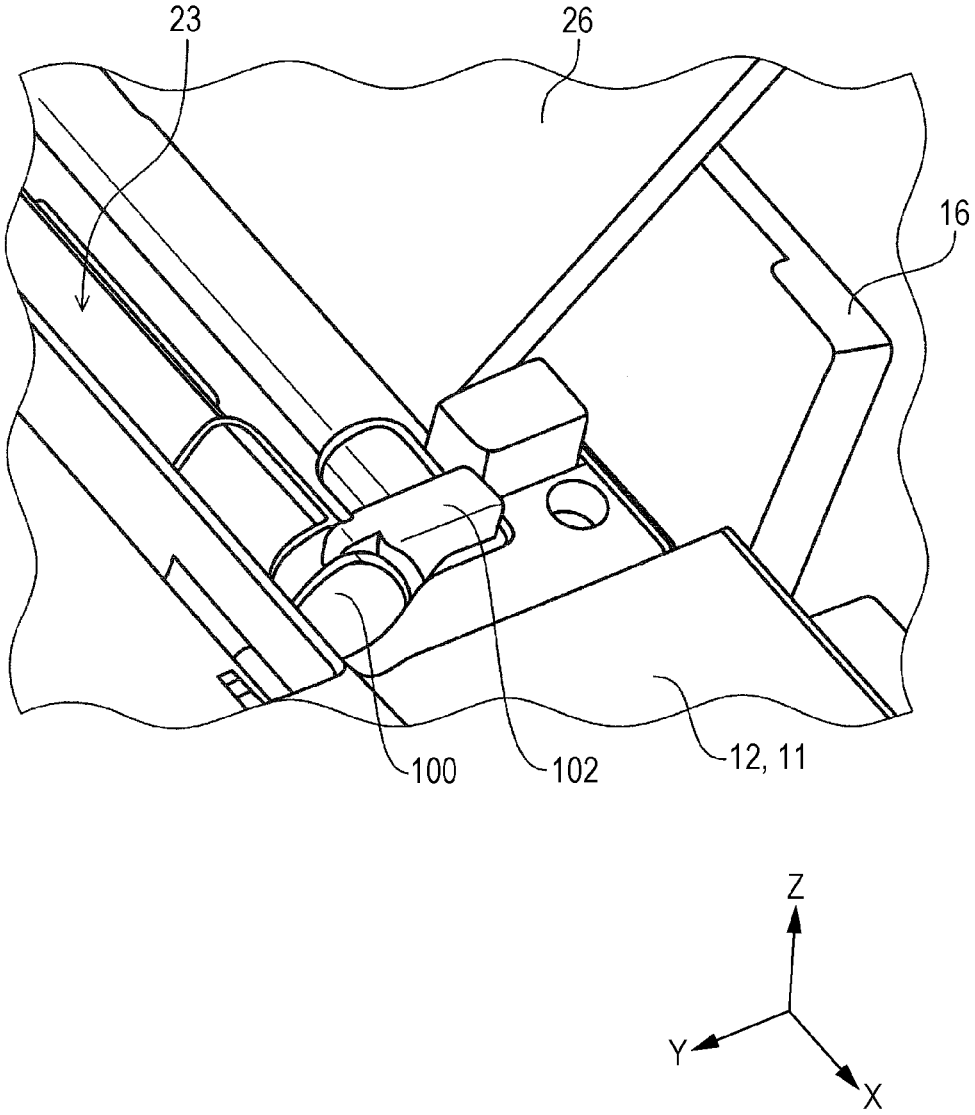
FIG. 15 is an enlarged perspective view of portions of the printer.
Figure 16A:
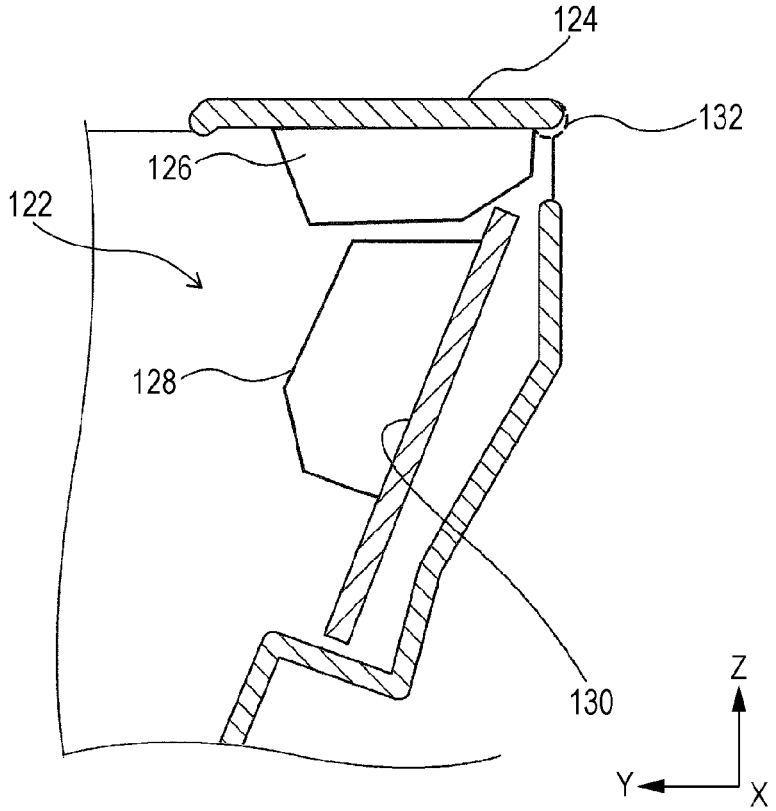
FIG. 16A is a diagram representing an example of disposal of a related-art subsidiary edge guide.
Figure 16B:
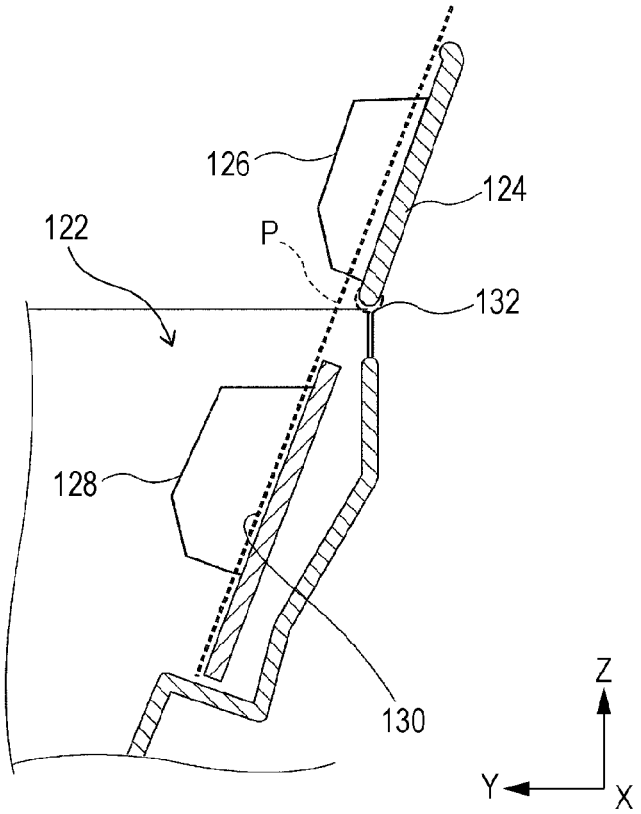
FIG. 16B is a diagram representing an example of disposal of the related-art subsidiary edge guide.

FIGS. 14A and 14B are each a sectional view of portions of a printer. FIG. 14A shows a state in which a sheet feed cover is closed. FIG. 14B is a state in which the sheet feed cover is open. FIG. 15 is an enlarged perspective view of portions of the printer shown in FIG. 2A. FIGS. 16A and 16B are diagrams representing an example of an arrangement of a related-art subsidiary edge guide. FIG. 16A shows a state in which the sheet feed cover is closed. FIG. 16B shows a state in which the sheet feed cover is open.

As shown in FIGS. 14A, 14B and 15, the medium setting unit 23 in which sheets P are set is provided with an edge guide 100 that guides two opposite side ends of each sheet P in the width direction thereof (the X axis direction in the drawings).

In a related-art printer constructed so that when the printer is stored (when it is not used), a medium setting unit 122 can be covered with a sheet feed cover 124 as shown in FIGS. 16A and 16B, there is a case where the sheet feed cover 124 opened during use of the printer is used as a paper support (sheet support portion) that supports sheets P set in the medium setting unit 122.

In such a case, the sheet feed cover 124 provided as a paper support is provided with a subsidiary edge guide 126 that guides two opposite side ends of the sheets P supported.

The provision of the subsidiary edge guide 126 on the sheet feed cover 124 that is pivotally opened and closed causes a problem that in order to avoid interference of the subsidiary edge guide 126 with another component member (e.g., an edge guide 128) during the pivoting of the sheet feed cover 124, dead space is increased in size and therefore the apparatus size becomes large.

Furthermore, because the position of a pivot shaft 132 of the sheet feed cover 124 that performs the paper support function is determined by positional relations with a sheet mounting surface 130 of the medium setting unit 122 or with the edge guide 128, the layout is restricted.

In this exemplary embodiment, as shown in FIGS. 14A, 14B and 15, a subsidiary edge guide 102 is disposed on the main body upper portion 12. This eliminates the need to provide a subsidiary edge guide on the sheet feed cover 16, so that the dead space for opening and closing the sheet feed cover 16 can be reduced.

In addition, because the subsidiary edge guide 102 is provided independently of the paper support, the degree of freedom in designing the paper support increases. For example, in this exemplary embodiment, the sheet feed cover 16 is not designed to also perform a paper support function but a paper support (sheet support portion 26) retractable into the apparatus main body portion 11 is separately provided.

Incidentally, the invention is not limited to the foregoing exemplary embodiments but can be modified or changed in various manners within the scope of the invention described in the appended claims, and such modifications and changes are, of course, encompassed within the scope of the invention.

The entire disclosure of Japanese Patent Application No. 2015-0044629 filed on Mar. 6, 2015 and No. 2015-0044640 filed on Mar. 6, 2015 are expressly incorporated by reference herein.

What is claimed is:

1. A recording apparatus comprising:

an apparatus main body portion that contains a recorder that performs recording on a recording medium; and a panel having a display unit that displays various information and being capable of opening and closing an upper portion of the apparatus main body portion by pivoting relative to the apparatus main body portion about a first pivot shaft;

an arm that maintains an open state of the panel by engaging with a back surface of the panel, the apparatus main body including an arm housing portion configured to receive the arm when the panel is closing the upper portion of the apparatus main body portion, wherein:

the panel has an outer perimeter that includes two short sides and two long sides;

the display unit has an outline that includes two short sides and two long sides and is provided on the panel so that a longitudinal direction of the display unit is the same as a longitudinal direction of the panel; and the panel pivots about one of the two short sides to intersect the longitudinal direction.

2. The recording apparatus according to claim 1, wherein the display unit has a size that is larger than or equal to a postcard size.

3. The recording apparatus according to claim 1, wherein:

in the apparatus main body portion, the first pivot shaft is provided at a side surface portion that faces a direction that intersects a recording medium transport direction; and when the apparatus main body portion is placed so that the panel in an open state is at a front, the recording medium transport direction is a left-right direction.

4. The recording apparatus according to claim 3, wherein when the apparatus main body portion is placed so that a discharge opening of the recording medium is at the front, the first pivot shaft is at a right side surface of the apparatus main body portion.

5. The recording apparatus according to claim 3, wherein the panel, when closed, covers an entire region of the upper portion of the apparatus main body portion in a direction that intersects the recording medium transport direction.

6. The recording apparatus according to claim 3, further comprising:

a medium setting unit in which the recording medium is set;

a carriage that is provided with the recorder and that is movable in a direction that intersects the recording medium transport direction, wherein a position of the arm in the recording medium transport direction is between the medium setting unit and the carriage.

7. The recording apparatus according to claim 6, wherein the arm holds the panel at a plurality of angles of aperture.

8. The recording apparatus according to claim 6, wherein in an apparatus height direction, at least a portion of the arm and at least a portion of the carriage are at positions equal in height.

9. The recording apparatus according to claim 1, further comprising a handle pivotable relative to the apparatus main body portion about a second pivot shaft, wherein both the first pivot shaft and the second pivot shaft are provided at a same side surface side of the apparatus main body portion.

10. The recording apparatus according to claim 9, wherein:

the upper surface of the apparatus main body portion changes between when the recording apparatus is in a state for recording and when the recording apparatus is in a state for carrying the recording apparatus by grasping the handle; and the first pivot shaft and the second pivot shaft are provided at a surface side of the apparatus main body portion which is a side surface side when the recording apparatus is in the state for recording.

11. The recording apparatus according to claim 10, wherein a pivot axis of the first pivot shaft and a pivot axis of the second pivot shaft are substantially parallel to each other.

12. The recording apparatus according to claim 11, wherein the second pivot shaft is below the first pivot shaft.

13. The recording apparatus according to claim 9, wherein:

the panel is provided pivotably relative to the apparatus main body portion via a hinge portion that includes the first pivot shaft;

the handle is provided pivotably relative to the apparatus main body portion via an attaching member that includes the second pivot shaft;

the apparatus main body portion includes an upper-side apparatus main body portion that constitutes an upper side and a lower-side apparatus main body portion that constitutes a lower side; and the hinge portion, the upper-side apparatus main body portion, and the lower-side apparatus main body portion are fixed to the attaching member.

14. The recording apparatus according to claim 13, wherein:

a side surface of the lower-side apparatus main body portion is provided with a protruded portion that is protruded sideways; and the protruded portion is provided with the attaching member.

15. The recording apparatus according to claim 14, wherein:

the handle has a substantially square U shape; and when the handle is closed, the handle lies around the protruded portion and constitutes, together with the protruded portion, a side surface of the recording apparatus without protruding outward from the side surface of the lower-side apparatus main body portion.

16. The recording apparatus according to claim 15, wherein:

the handle is provided with a recess portion that receives the second pivot shaft;

the recess portion is provided with an allowance that, when the handle is closed, allows the handle to move in a direction that intersects a pivot axis direction of the handle; and the handle, when closed, assumes a state in which a gap between the handle and the protruded portion is eliminated due to urging force of an urger.

17. The recording apparatus according to claim 9, wherein the handle and the panel have a positional relation such that neither one of the handle and the panel interferes with the other one of the handle and the panel when pivoting.

18. A recording apparatus comprising:

an apparatus main body portion that contains a recorder that performs recording on a recording medium; and a panel having a display unit that displays various information and being capable of opening and closing an upper portion of the apparatus main body portion by pivoting relative to the apparatus main body portion about a first pivot shaft;

an arm that maintains an open state of the panel by engaging with a back surface of the panel, the apparatus main body including an arm housing portion configured to receive the arm when the panel is closing the upper portion of the apparatus main body portion; and a medium setting portion that sets the recording medium, wherein the panel has an outer perimeter that includes two short sides and two long sides;

the medium setting portion that is arranged at the upper portion and a long side of the two long sides of the apparatus main body except for an area of the panel;

the display unit has an outline that includes two short sides and two long sides and is provided on the panel so that a longitudinal direction of the display unit is the same as a longitudinal direction of the panel; and the panel pivots about one of the two short side to intersect the longitudinal direction.

19. The recording apparatus according to claim 18, wherein when the apparatus main body portion is placed so that a discharge opening of the recording medium is at a front, the first pivot shaft is at a right side surface of the apparatus main body portion.

20. The recording apparatus according to claim 18, further comprising a handle pivotable relative to the apparatus main body portion about a second pivot shaft, wherein both the first pivot shaft and the second pivot shaft are provided at the same side surface side of the apparatus main body portion.

21. The recording apparatus according to claim 20, wherein:

the upper surface of the apparatus main body portion changes between when the recording apparatus is in a state for recording and when the recording apparatus is in a state for carrying the recording apparatus by grasping the handle; and the first pivot shaft and the second pivot shaft are provided at a surface side of the apparatus main body portion which is a side surface side when the recording apparatus is in the state for recording.

* * * * *